US007933541B2

(12) United States Patent
Kodera et al.

(10) Patent No.: US 7,933,541 B2
(45) Date of Patent: Apr. 26, 2011

(54) IMAGE-FORMING METHOD AND IMAGE-FORMING APPARATUS

(75) Inventors: Tetsuro Kodera, Kanagawa (JP); Naoyuki Egusa, Kanagawa (JP); Tomoo Kobayashi, Kanagawa (JP); Kaoru Torikoshi, Kanagawa (JP); Kunio Sakurai, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 298 days.

(21) Appl. No.: 11/520,673

(22) Filed: Sep. 14, 2006

(65) Prior Publication Data

US 2007/0065187 A1 Mar. 22, 2007

(30) Foreign Application Priority Data

Sep. 16, 2005 (JP) ..... 2005-270900
May 1, 2006 (JP) ..... 2006-127821
Jul. 28, 2006 (JP) ..... 2006-207018

(51) Int. Cl.
*G03G 15/16* (2006.01)

(52) U.S. Cl. ..... 399/307

(58) Field of Classification Search ..... 399/307
See application file for complete search history.

(56) References Cited

U.S. PATENT DOCUMENTS 5,215,852 A * 6/1993 Kato et al. ..... 430/125.32
5,363,179 A 11/1994 Cahill et al.
5,394,176 A * 2/1995 Itaya et al. ..... 347/128
5,400,126 A 3/1995 Cahill et al.
5,414,502 A * 5/1995 Cahill et al. ..... 399/307
5,428,430 A * 6/1995 Aslam et al. ..... 399/307
5,475,480 A 12/1995 Cahill et al.
5,483,321 A 1/1996 Cahill et al.
5,488,455 A 1/1996 Cahill et al.
5,601,959 A 2/1997 Cahill et al.
5,789,134 A 8/1998 Brault et al.

(Continued)

FOREIGN PATENT DOCUMENTS

CN 1121335 A 4/1996

(Continued)

OTHER PUBLICATIONS

Office Action issued in JP Application No. 2006-207018 on Jan. 5, 2011 (with English translation).

*Primary Examiner* — David M Gray
*Assistant Examiner* — Andrew V Do
(74) *Attorney, Agent, or Firm* — Oliff & Berridge, PLC

(57) ABSTRACT

An image-forming method includes forming a toner image on the surface of an image carrier, transferring the toner image from the surface of the image carrier onto an image-receiving layer of a belt-shaped intermediate transfer film that is provided on a surface of a base material, superimposing the intermediate transfer film on a surface of a recording medium such that the toner image contacts the surface of the recording medium, fixing the toner image by application of heat and pressure, forming a laminate by pressure-bonding the superimposed intermediate transfer film onto the recording medium by application of heat and pressure, and peeling the base material off the image-receiving layer at the interface therebetween, so that the entire image-forming surface of the recording medium is covered with the image-receiving layer and the image is formed between the recording medium and the image-receiving layer.

22 Claims, 6 Drawing Sheets

U.S. PATENT DOCUMENTS

2005/0175819 A1 8/2005 Kobayashi et al.

FOREIGN PATENT DOCUMENTS

| | | | |
|---|---|---|---|
| CN | 1655068 | A | 8/2005 |
| JP | A 63-58374 | | 3/1988 |
| JP | A 63-259575 | | 10/1988 |
| JP | A 3-2765 | | 1/1991 |
| JP | A 4-204670 | | 7/1992 |
| JP | A 4-242752 | | 8/1992 |
| JP | A 4-278967 | | 10/1992 |
| JP | A 5-142963 | | 6/1993 |
| JP | A 5-232840 | | 9/1993 |
| JP | A 7-72696 | | 3/1995 |
| JP | A-10-207276 | | 8/1998 |
| JP | A-10-232517 | | 9/1998 |
| JP | A 10-319663 | | 12/1998 |
| JP | A 10-319755 | | 12/1998 |
| JP | A-11-015305 | | 1/1999 |
| JP | A 11-202583 | | 7/1999 |
| JP | A-2001-092274 | | 4/2001 |
| JP | A-2001-272866 | | 10/2001 |
| JP | A-2005-024938 | | 1/2005 |
| JP | A 2005-227377 | | 8/2005 |

* cited by examiner

IMAGE-FORMING METHOD AND IMAGE-FORMING APPARATUS

BACKGROUND

1. Technical Field

The present invention relates to an image-forming method of forming an image on a recording medium such as a plastic sheet in an electrophotographic process, and an image-forming apparatus such as a copying machine or a printer using the same.

2. Related Art

In electrophotographic processes, a color image has been formed, for example, in the following image-forming steps. Light is first irradiated on a color manuscript; the reflected optical image is detected by a color CCD with color separation; and image signals for multiple colors are obtained in an image-processor after predetermined image processing and color correction. For example, semiconductor laser is modulated based on the image signals for multiple colors, and semiconductor laser light modulated according to the image signals is emitted from the semiconductor laser. Multiple electrostatic latent images are formed on a photoreceptor by irradiating the laser beam multiple times each for one of the colors. The multiple electrostatic latent images are developed sequentially with color toners, for example in four colors of yellow (Y), magenta (M), cyan (C), and black (K). The developed toner images are then transferred from the photoreceptor onto an image-receiving medium such as paper and are heat-fixed with a fixing device having an heat-fixing roll or the like, to form a color image on the image-receiving medium.

The color toners used in these color image-forming apparatuses are, for example, particles having an average diameter of 1 to 15 μm made of a binder resin such as polyester resin, styrene/acrylic copolymer, or styrene/butadiene copolymer containing a colorant dispersed therein, on which fine particles having an average diameter of approximately 5 to 100 nm, for example inorganic fine particles such as of silicon oxide, titanium oxide, or aluminum oxide or resin fine particles such as of PMMA or PVDF are adhered. Examples of the colorant include yellow (Y) colorants such as benzidine yellow, quinoline yellow, and Hanza Yellow; magenta (M) colorants such as rhodamine B, rose bengal, and pigment red; cyan (C) colorants such as phthalocyanine blue, aniline blue, and pigment blue; black (K) colorants such as carbon black and aniline black; blends of color pigments; and the like.

The thus-obtained color image made of the color toners has a certain degree of glossiness since the surface thereof is smoothened at heat fixation. On the other hand, the paper surface is normally not glossy; and thus, the color image has a different glossiness from that of the paper surface. In addition, the glossiness of the color image is known to change as a result of variation of the viscosity of the toner at heat fixation depending on the kind of the binder resin used for color toner and the method of heat fixing.

By the way, preferred glossiness of a color image varies depending on the kind and application of the image. For example, when the color image is formed on a plastic sheet such as a display board or an outdoor display, a color image having a uniform surface higher in glossiness is generally preferred.

SUMMARY

According to a first aspect of the invention, there is provided an image-forming method comprising:

forming a toner image on the surface of an image carrier;

transferring the toner image from the surface of the image carrier onto an image-receiving layer of a belt-shaped intermediate transfer film in which the image-receiving layer is provided on a surface of a base material;

superimposing the intermediate transfer film on a surface of a recording medium such that the toner image contacts the surface of the recording medium;

fixing the toner image by application of heat and pressure;

forming a laminate by pressure-bonding the superimposed intermediate transfer film onto the recording medium by application of heat and pressure; and peeling the base material off the image-receiving layer at the interface therebetween, so that the entire image-forming surface of the recording medium is covered with the image-receiving layer and so that the image is formed between the recording medium and the image-receiving layer.

BRIEF DESCRIPTION OF THE DRAWINGS

Embodiments of the present invention will be described in detail based on the following figures, wherein.

DETAILED DESCRIPTION

Figure 5:
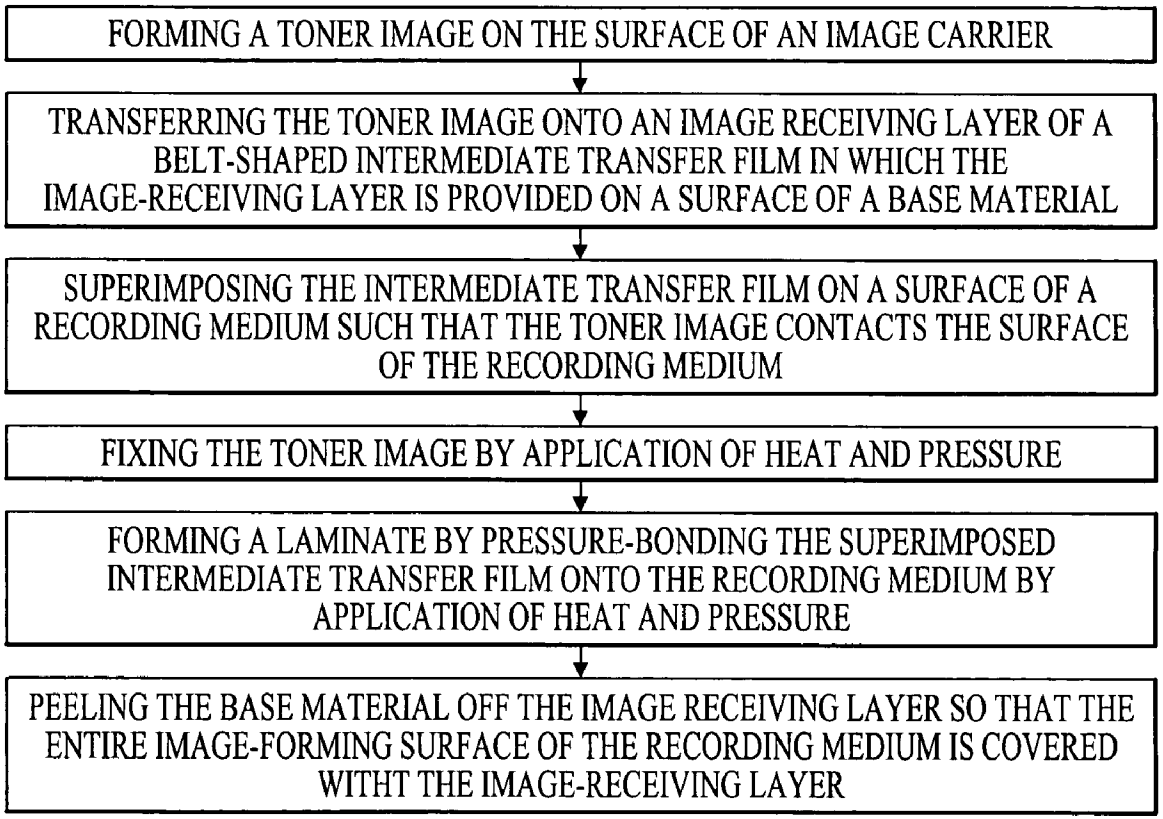
FIG. 5 is a flowchart showing the operation of another example of the image-forming apparatus according to an aspect of the invention.
Figure 6:
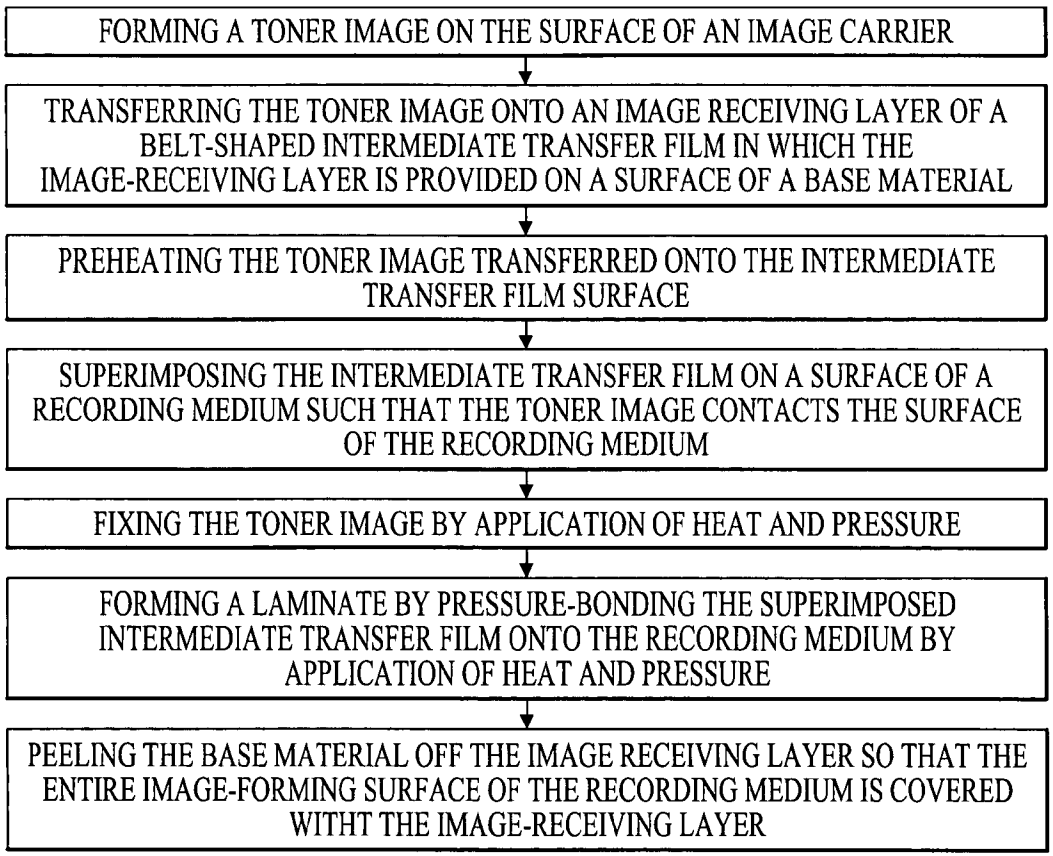
FIG. 6 is a flowchart showing the operation of another example of the image-forming apparatus according to an aspect of the invention.

FIG. 5 shows the operation of the image-forming apparatus as discussed in more detail below, and FIG. 6 shows a flowchart of a slight modification of the steps shown in FIG. 5.

Image-Forming Method

The image-forming method according to an aspect of the invention comprises:

forming a toner image on the surface of an image carrier;

transferring the toner image from the surface of the image carrier onto an image-receiving layer of a belt-shaped intermediate transfer film in which the image-receiving layer is provided on a surface of a base material;

superimposing the intermediate transfer film on a surface of a recording medium such that the toner image contacts the surface of the recording medium;

fixing the toner image by application of heat and pressure;

forming a laminate by pressure-bonding the superimposed intermediate transfer film onto the recording medium by application of heat and pressure; and peeling the base material off the image-receiving layer at the interface therebetween, so that the entire image-forming surface of the recording medium is covered with the image-receiving layer and so that the image is formed between the recording medium and the image-receiving layer.

The recording medium may be any recording medium on which an image can be formed by an electrophotographic process, such as paper or a plastic sheet, and the surface irregularity of the recording medium varies depending on the kind of the recording medium. The surface irregularity of the image obtained also varies depending on whether the image is monochromic or colored, on the particle diameter of the toner used for image formation, or on the image-forming condition (for example, fixing temperature, etc.). Thus, in conventional image-forming methods, it is quite difficult to make the surface smoothness of the recording medium used always identical with that of the formed image. For that reason, it has been unavoidable that a difference in glossiness is generated between the image and non-image regions on the image-forming surface.

The image-forming method according to an aspect of the invention is significantly different from the conventional electrophotographic image-forming methods using an intermediate transfer body such as an intermediate transfer belt, in that a belt-shaped transfer film (intermediate transfer film) having a base material and an image-receiving layer provided on a surface of the base material is used as the intermediate transfer body.

The intermediate transfer film is not particularly limited as long as it is belt-shaped. The aspect ratio (length/width) thereof is preferably 5 or more, more preferably 10 or more, and still more preferably 20 or more. The length of the intermediate transfer film is preferably 1 m or more, more preferably 2 m or more, and still more preferably 4 m or more.

The width of the belt-shaped intermediate transfer film means a length in the direction perpendicular to the rotation direction of the image carrier, and may be normally set to be almost identical with the width of the image carrier or with the width of the recording medium to be used (length in the direction perpendicular to the recording medium-supplying direction).

The intermediate transfer film may be an endless film. In such a case, the length of the intermediate transfer film means the length of the endless film along one round.

On the other hand, conventionally, when a large quantity of recording media having an image formed thereon are produced using an intermediate transfer film, it has been necessary to form the image on a recording medium by using a large sheet-shaped intermediate transfer film and cut the recording medium into pieces of a predetermined size. However, high productivity has not been always achieved since the recording media has to be cut after image formation.

From the viewpoint, the recording medium for use in the aspect of the invention may be sheet-shaped. When the recording medium is sheet-shaped, use of a recording medium previously cut into the size of the final product eliminates the necessity for cutting the recording medium after image formation, and thus gives high productivity.

The length of the intermediate transfer film in this case is preferably at least 5 times, (more preferably at least 10 times, and still more preferably at least 20 times) the length of the recording medium in the feed direction.

The shape of the recording medium for use in the aspect of the invention is not limited to a sheet shape, and may be, for example, a belt shape. In such a case, a belt-shaped recording medium having an image formed thereon is obtained. The width of the intermediate transfer film in this case may be almost identical with the width of the belt-shaped recording medium, and the length of the intermediate transfer film is preferably at least one time (more preferably at least 5 times, and still more preferably at least 10 times) the length of the belt-shaped recording medium.

In the image-forming method according to an aspect of the invention, it is possible to form a monochromic image by using one kind of toner, and also possible to form a color image by using two or more kinds of toner different in color. Since a color image is fixed after two or more color toner images different in color are superimposed, the color image tends to have a greater image-surface irregularity than a monochromic image, and normally has enlarged difference in glossiness between the image and non-image regions; therefore, the glossiness on the entire image-forming surface is likely to be uneven.

However, in the image-forming method according to an aspect of the invention, it is possible to prevent such a problem and achieve uniform glossiness on the entire image-forming surface because the image and non-image regions are both covered with an image-receiving layer.

Each process in the image-forming method according to an aspect of the invention will be described below. As described above, the image-forming method according to an aspect of the invention include forming a toner image, transferring, superimposing, fixing, forming of a laminate, and peeling, and, optionally as necessary, other processes employed in known electrophotographic image-forming methods, such as cleaning the image carrier surface after transfer of the toner image onto the intermediate transfer film.

The formation of the toner image can be conducted similarly to a conventional image-forming method, and the transferring can also be conducted similarly to that in conventional image-forming methods, except that the intermediate transfer film described above is used as the intermediate transfer body.

The superimposing, fixing and forming of a laminate are performed between the transferring and the peeling, and may be performed in the order of superimposing, fixing, and forming of a laminate (process A), or in the order of fixing, superimposing, and forming of a laminate (process B). As an alternative, the fixing and the forming of a laminate may be conducted simultaneously after the superimposing (process C), or the superimposing and the forming of a laminate may be conducted simultaneously after the fixing (process D). However, it is preferable from the simplification of the process to conduct the superimposing, the fixing, and the forming of a laminate simultaneously (process E). In the process E, to be exact, the fixing and the forming of a laminate are conducted at the same time immediately after the superimposing.

The processes A, C, D, and E, in which the fixing is conducted after the superimposing, have an advantage in that heating unit for fixing such as a heating roll does not directly contact the toner image during fixing of the toner image, so that offsetting of the toner image onto the heating unit does not occur.

A device having similar structure to conventional fixing devices can be used in process E. An example is a heat-pressing unit comprising a heating roll and a pressure roll pressed against the heating roll. When using such a unit, it is possible to conduct fixing and forming of a laminate by passing the intermediate transfer film and the recording medium in the stacked state through the nip portion between the heating roll and the pressure roll.

After the above processes, the base material of the laminated film is peeled off the image-receiving layer at the interface therebetween. In this way, a recording medium whose surface having the image is entirely covered with the image-receiving layer can be obtained.

The peeling is not particularly limited as long as the base material can be peeled off the image-receiving layer at the interface therebetween. The peeling may be conducted by applying a force that pulls one side or both sides of the laminate in the thickness direction of the laminate. When the peeling force is applied on one side of the laminate, the other side may be fixed.

When a recording medium consisting of a plastic film is used for production of a plastic card in an aspect of the invention, the plastic card obtained after the peeling is deformed in some cases if the heat resistance of the plastic film in the laminate is low. The reason is as follows. The laminate after the fixing and the forming of the laminate has a quite high temperature. Therefore, when the laminate just after the formation thereof is subjected to the peeling, the plastic card itself easily deforms upon application of a moderate external force. This problem occurs more frequently when a plastic film consisting of a material having a relatively low glass transition temperature, such as a vinyl chloride film or a PETG film (a modified PET resin film including at least ethylene glycol, terephthalic acid, and 1,4-cyclohexanedimethanol as copolymerization components), is used or when the fixing temperature is higher than the glass transition temperature of the resin material constituting the plastic film.

Accordingly, when prevention of such a deformation is desired, it is possible to conduct a cooling process in which the laminate is cooled in the state of being sandwiched between a pair of members whose surfaces facing both surfaces of the laminate are planar, after the fixing and the forming of the laminate but before the peeling.

When such a cooling process is conducted, the sufficiently heated laminate after the fixing and the forming of the laminate is sufficiently cooled to a temperature at which the laminate hardly deforms upon application of a moderate force while the flat shape of the laminate is maintained, before the peeling. Consequently, prevention of the deformation of the finally-obtained plastic card is ensured. This method is effective particularly when the recording medium to be used is a vinyl chloride film or a PETG film, or when the fixing temperature is higher than the glass transition temperature of the resin material constituting the plastic card.

The cooling conducted in the cooling process may be natural cooling or forced cooling. Forced cooling is preferred since the cooling time can be shortened.

In the image-forming method according to an aspect of the invention, the toner image transferred onto the surface of the intermediate transfer film may be temporarily fixed by being preheated, after the transferring but before the fixing. Fusing among the toner particles constituting the toner image or between the toner particles and the image-receiving layer thereby occurs before fixing, and thus deterioration of the toner image can be prevented at fixing. Therefore, deterioration of the obtained image can be prevented.

When the temporary fixing is conducted, the temporary fixing is preferably conducted by heating to a somewhat lower (approximately 60° C. to 80° C. lower) temperature than the temperature at fixing the toner image, using heating a device such as heating roll disposed at one or both surfaces of the intermediate transfer film.

The superimposing may be performed after preheating the recording medium.

The recording medium can be preheated to a temperature suitable for fixing in advance, by heating the recording medium in this manner before fixing or before superimposing conducted simultaneously with the fixing.

It is thus possible to easily prevent generation of fixing defects and make the fixing temperature at fixing lower than before. The preheating described above is particularly effective when a thicker recording medium such as plastic film is used. Increase in the thickness of recording medium leads to increase in the heat capacity of the recording medium itself, and makes it difficult for the short-term heating at fixing to sufficiently heat the recording medium to a temperature suitable for fixing; further, sufficient heating of a recording medium such as plastic film is likely to cause thermal deformation of the recording medium. However, when the recording medium is preheated before fixing, it is possible to prevent fixing defects caused by insufficient heating of the recording medium and thermal deformation of the recording medium. From the viewpoints above, it is possible to conduct preheating when the recording medium to be used is a medium containing a thermoplastic material such as plastic film, and the thickness thereof is approximately 0.5 mm to 5.0 mm.

—Intermediate Transfer Film—

Hereinafter, the belt-shaped intermediate transfer film for use in an aspect of the invention will be described in more details. The intermediate transfer film for use in an aspect of the invention includes a base material and an image-receiving layer provided on one surface of the base material.

The toner image formed on the image carrier surface is transferred onto the surface of the image-receiving layer at the transferring. The image-receiving layer and the base material should be releasable; a release layer containing a releasing material may be provided between the image-receiving layer and the base material; or the releasability may be imparted by coating a releasing material on one of (i) the base material side of the image-receiving layer or (ii) the image-receiving layer side of the base material.

The releasing material may be, for example, a silicone-based hardcoat material, and examples thereof include condensation resins containing a silane-based composition and mixed materials containing a condensation resin of a silane-based composition and a colloidal silica dispersion.

When a release layer is provided between the base material and the image-receiving layer of intermediate transfer film, the peeling strength between the release layer and the image-receiving layer is preferably in the range of 9.8 mN/cm to 4.9 N/cm (1 gf/cm to 500 gf/cm), more preferably in the range of 19.6 mN/cm to 0.98 N/cm (2 gf/cm to 100 gf/cm).

A peeling strength of less than 9.8 mN/cm (1 gf/cm) may lead to spontaneous peeling of the base material off the image-receiving layer. On the other hand, a peeling strength of more than 4.9 N/cm (500 gf/cm) may hinder peeling at the interface between the base material and the image-receiving layer when a peeling force is applied to both surfaces of the laminate obtained by laminating the recording medium with the intermediate transfer film.

The peeling force between the release layer and the image-receiving layer is determined by adhering an acrylic adhesive tape having a width of 10 mm (Nitto Polyester Tape 31B, manufactured by Nitto Denko Corp.) to a length of 200 mm on the image-receiving layer surface of the intermediate transfer film at a linear pressure of 500 g/cm and measuring the stress when the tape is peeled off at a speed of 10 mm/sec and a peeling angle of 180°. The measured stress is assumed as the peeling force.

The image-receiving layer includes a thermoplastic material. The thermoplastic material is not particularly limited, and may contain a resin similar to the binder resin contained in the toner used in image formation, in particular a polyester resin. Polyester resins are widely used as the binder resin for toner. Therefore, the fixability of the image-forming material onto the image-receiving layer can be improved by adding a similar resin into the image-receiving layer. Examples of the polyester resins include common polyester resins, as well as silicone-modified polyester resins, urethane-modified polyester resins, and acrylic-modified polyesters.

The base material is not particularly limited, and may be a plastic film as a typical example. Among plastic films, a polyacetate film, a cellulose triacetate film, a nylon film, a polyester film, a polycarbonate film, a polysulfone film, a polystyrene film, a polyphenylene ether film, a cycloolefin film, a polypropylene film, a cellophane, an ABS (acrylonitrile-butadiene-styrene) resin film, a biaxially-stretched polyethylene terephthalate (PET) film, or the like can be used favorably. Among them, use of biaxially-stretched polyethylene terephthalate is preferable from the point of cost performance.

The base material is heated and pressed during fixing. In addition, when a recording medium with a relatively large thickness (such as plastic sheet) is used, the fixing temperature should be set at a higher temperature because of its larger heat capacity, and thus, the base material is heated to high temperature in some cases. There are cases in which such heating and pressurization or an excessively severe heating condition causes elongation of the base material in the longitudinal direction during fixing, which causes elongation of the image.

Thus, use of a plastic film superior in the stretching resistance during heating and pressurization is preferable from the viewpoint of suppressing the image elongation. Examples of the films include biaxially stretched polyethylene naphthalate (PEN) film, aromatic polyamide (aramide) film, polyimide film, polyphenylene sulfide (PPS) film, and polyether imide (PEI) film.

A laminate film including a stack composed of a combination of two or more of the above films may be used as necessary as the film for the base material.

The surface roughness of the surface of the base material, which surface is on the side at which the image-receiving layer is provided, is not particularly limited, but the center line average roughness Ra is preferably 1 μm or less, more preferably 0.1 μm or less, in order to obtain high glossiness on the entire image-forming surface. A center line average roughness Ra of more than 1 μm may prohibit high glossiness.

The center line average roughness Ra of the base material may be smaller from the viewpoint of obtaining high glossiness, but is preferably 0.05 μm or more from the practical viewpoint.

On the other hand, the center line average roughness Ra is preferably 20 μm or more, more preferably 25 μm or more, when the entire image-forming surface is desired to have a matt finishing (low glossiness). A center line average roughness Ra of less than 20 μm may make it difficult to make the entire image-forming surface appear matt-finished. Although the center line average roughness Ra of the base material may be greater from the viewpoint of obtaining matt finishing, the center line average roughness Ra is preferably 50 μm or less from the practical viewpoint.

The center line average roughness (Ra) is determined with a stylus profilometer DEKTAK3ST manufactured by Ulvac Inc.

The thickness of the base material is preferably in the range of 10 μm to 200 μm, more preferably in the range of 25 μm to 100 μm, from the viewpoint of preventing conveyance defects and deterioration in image quality. A thickness of less than 10 μm may cause conveyance defects in the image-forming apparatus, while a thickness of more than 200 μm may lead to deterioration in image quality at transfer.

The thickness of the base material is preferably 50 μm or less, more preferably 40 μm or less, for prevention of generation of minute residual air in the image-forming surface after forming of a laminate. A thickness of the base material of more than 50 μm may lead to generation of fine residual air on the image-forming surface because the intermediate transfer film cannot follow and adhere to the irregularity on the surface of the recording medium which surface contacts the intermediate transfer film at forming of a laminate. The thickness of the base material may be smaller from the viewpoint of preventing generation of minute residual air, but is preferably 10 μm or more, more preferably 18 μm or more in practice from the viewpoint of preventing occurrence of conveyance defects and others associated with insufficient strength of the base material.

From the viewpoint of securing the strength of the base material and suppressing the minute residual air and image elongation, examples of the plastic films favorably used as a base material having a thickness in the range of 10 μm to 50 μm include the biaxially stretched PEN film, aromatic polyamide (aramide) film, polyimide film, PPS film, and PEI film described above.

The surface resistivity of at least the image-receiving layer side of the intermediate transfer film at a temperature of 23° C. and a humidity of 55 RH % is preferably in the range of $1.0\times10^{8}\Omega$ to $1.0\times10^{13}\Omega$, more preferably in the range of $1.0\times10^{9}\Omega$ to $1.0\times10^{11}\Omega$; and still more preferably, both sides of the intermediate transfer film have a surface resistivity with the above range.

When the surface resistivity is less than $1.0\times10^{8}\Omega$, the resistance of the intermediate transfer film, especially under high temperature and high humidity, becomes excessively low, and for example, the transfer of the toner from the image carrier is disturbed in some cases. When the surface resistivity is more than $1.0\times10^{13}\Omega$, the resistance of the intermediate transfer film becomes excessively high, and for example, the toner from the image carrier cannot be transferred onto the film surface, and image defects occurs in some cases.

The surface resistivity is measured by a method in conformity with the double-ring electrode method defined in JIS K6911 (which is incorporated herein by reference) and the calculation formulae described therein. More specifically, the surface resistivity is obtained from the electric current value at the time a voltage of 1000 V has been applied to circular electrodes (for example, "HR probe" of HIRESTER IP manufactured by Mitsubishi Yuka Co., Ltd.) connected to a digital ultrahigh resistance/microammeter R8340 manufactured by Advantest corporation for 60 seconds in an environment of 23.degree. C. and 55% RH, using the formulae defined in JIS K6911.

The surface resistivity can be controlled in the range of $1.0\times10^{8}$ to $1.0\times10^{13}\Omega$ adding a polymeric conductive agent, a surfactant, conductivity metal oxide particles, or the like as an antistatic agent to the image-receiving layer, by adding a surfactant, a polymeric conductive agent, conductive fine particles or the like to the resin during production of the film for the base material, by applying a surfactant onto the film surface, by vapor-depositing a metal thin film, or by adding an adequate amount of surfactant or the like to the adhesive or the like.

—Recording Medium—

The recording medium for use in an aspect of the invention is not particularly limited as long as an image can be formed thereon, and examples thereof include common papers, plastic, metal, or ceramic films, and other films. Use of a plastic film is preferable.

The recording medium may be colored by addition of a pigment or dye. The recording medium may be film-shaped or plate-shaped, or may have a shape having such a thickness as to be nonflexible, or as to impart the required strength for use as a recording medium.

When the image-recording medium is applied to an IC card, a magnetic card, or the like, IC memory, antenna, external terminal, and the like are embedded in the recording medium. In an exemplary embodiment, a magnetic stripe, a hologram, or the like is separately printed on the recording medium, and characters may be embossed as necessary.

The recording medium is preferably a plastic film, more preferably a PET (polyethylene terephthalate) film, a PETG film (modified PET resin film copolymerized with at least ethylene glycol, terephthalic acid, and 1,4-cyclohexanedimethanol), or a polyvinyl chloride film. The thickness of the plastic film is preferably from 50 to 5,000 μm and more preferably from 100 to 1000 μm.

The plastic film is preferably opaque, and more preferably colored in white.

Typical examples of the plastic films include acetate film, cellulose triacetate film, nylon film, polyester film, polycarbonate film, polystyrene film, polyphenylene sulfide film, polypropylene film, polyimide film, and cellophane; and, among them, polyester film can used favorably. A biaxially-stretched polyethylene terephthalate film can be used particularly favorably.

(Toner/Developer)

The developer used in forming a toner image in an aspect of the invention may be a one-component developer consisting of toner or a two-component developer consisting of a toner and a carrier, and may be a known developer.

Any conventionally known toner containing a binder resin and a colorant may be used as the toner without restriction. The binder resin may be a known binder resin, and is preferably a polyester resin. The weight-average molecular weight thereof may be from 5,000 to 12,000.

The colorant is not particularly limited if it is commonly used in toner, and may be selected from known cyan pigments or dyes, magenta pigments or dyes, yellow pigments or dyes, and black pigments or dyes, and others. It is important to reduce the irregular reflection at the interface of the colorant pigment and the binder for obtaining high glossiness, and the combination with a colorant containing a small-diameter pigment uniformly dispersed therein described in JP-A No. 4-242752 is effective.

The particle diameter of the toner is not particularly limited, but is preferably from 4 μm to 8 μm from the viewpoint of obtaining a high-definition image.

The toner and the carrier for use in an aspect of the invention may be prepared as needed or may be commercially available products.

(Image-Forming Apparatus)

Hereinafter, the image-forming apparatus according to an aspect of the invention will be described. The image-forming apparatus according to an aspect of the invention is not particularly limited if it uses the image-forming method according to an aspect of the invention, and specifically, may have the following configuration.

The image-forming apparatus according to an aspect of the invention may comprise at least:

an image carrier, a toner image-forming unit that forms a toner image on the surface of the image carrier, a belt-shaped intermediate transfer film including a base material and an image-receiving layer provided on a surface of the base material, a transfer unit that transfers the toner image from the surface of the image carrier to the image-receiving layer of the intermediate transfer film, a heat-pressing unit which fixes the toner image by superimposing the intermediate transfer film on a surface of a recording medium such that the toner image contacts the surface of the recording medium, and applying heat and pressure to the intermediate transfer film and the recording medium, and which forms a laminate by pressure-bonding the intermediate transfer film to the recording medium, and a peeling unit that peels the base material off the image-receiving layer at the interface therebetween.

The heat-pressing unit is a unit that conducts superimposing, fixing, and forming a laminate almost simultaneously. Therefore, the heat-pressing unit conducts the process E. In an alternative exemplary embodiment, in order to conduct each process separately, the apparatus may comprise, instead of the heat-pressing unit, an superimposing unit that superimposes the recording medium on the intermediate transfer film, a fixing unit that fixes the toner image by application of heat and pressure, and a laminate forming unit that laminates the intermediate transfer film on the recording medium by application of heat and pressure.

The image-forming apparatus according to an aspect of the invention may further comprise other units used in conventional image-forming apparatuses, such as a cleaning unit (such as a cleaning blade) that cleans the surface of the image carrier. More preferably, the image-forming apparatus further comprises a temporary fixing unit that prefixes the toner image, which has been transferred onto the intermediate transfer film surface by the transfer unit, by preheating with the heat-pressing unit before fixing. The image-forming apparatus may also have, as necessary, a preheating unit that preheats the recording medium before the recording medium is superimposed on the intermediate transfer film to bring the transferred toner image into contact with the recording medium.

Hereinafter, the configuration of the image-forming apparatus according to an aspect of the invention will be described with reference to drawings.

Embodiment 1

Figure 1:
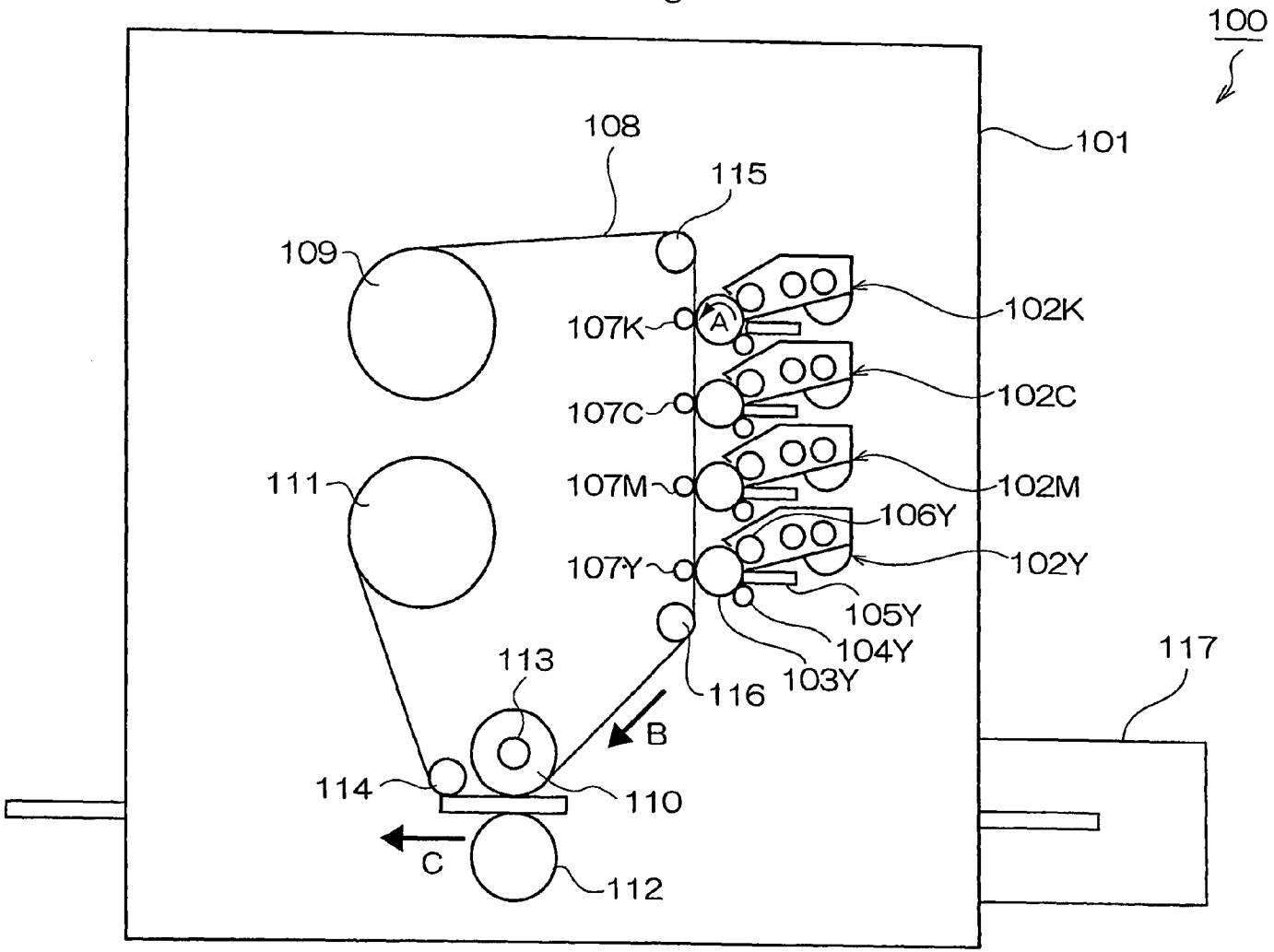
FIG. 1 is a schematic view illustrating the configuration of an example of the image-forming apparatus according to an aspect of the present invention.

FIG. 1 is a schematic view illustrating the configuration of an example of the image-forming apparatus according to an aspect of the invention. In FIG. 1, 100 represents an image-forming apparatus; 101 represents a chassis; 102K, 102C, 102M, and 102Y represent image-forming sections (toner image-forming units); 103Y represents a photoreceptor (image carrier); 104Y represents a primary charger; 105Y represents an LED array; 106Y represents a developing device; 107K, 107C 107M, and 107Y represent electrification rolls; 108 represents an intermediate transfer film; 109 represents a feed roll; 110 represents a heating roll; 111 represents a winding roll; 112 represents a pressure roll; 113 represents a heat source; 114 represents a peeling roll; 115 and 116 represent tension rolls; and 117 represents a recording medium-feeding tray.

The image-forming apparatus 100 is a so-called tandem apparatus having, in the chassis 101, four image-forming sections 102K, 102C, 102M, and 102Y that form toner images in black (K), cyan (C), magenta (M), and yellow (Y), respectively. The image-forming sections 102K, 102C, 102M, and 102Y are disposed at a constant interval in this order from the tension roll 115 side to the tension roll 116 side. The image-forming sections 102K, 102C, 102M, and 102Y are on the opposite side of the intermediate transfer film 108 to the side having tension rolls 115 and 116 thereon, and are disposed along the intermediate transfer film 108, which is stretched vertically between the tension rolls 115 and 116.

Although the four image-forming sections 102K, 102C, 102M, and 102Y have the same configuration except that the colors of the toner images to be formed are respectively black (K), cyan (C), magenta (M), and yellow (Y) in the present exemplary embodiment, the configuration of the image-forming section for a particular color may be altered from the others according to the frequency of use or the like. For example, in an exemplary embodiment, the diameter of the photoreceptor drum of a more frequently used image-forming section is enlarged, or the surface material of the photoreceptor can be changed to a material with higher durability, so that the lifetime of the system is elongated.

A feed roll 109 that feeds the belt-shaped long intermediate transfer film 108, a winding roll 111 that winds the intermediate transfer film 108 fed from the feed roll 109, and four rolls that stretch the intermediate transfer film 108 between the feed roll 109 and the winding roll 111 (tension roll 115, tension roll 116, heating roll 110, and peeling roll 114), are also contained in the chassis 101. The winding roll 111 is connected to a driving source (not shown in the Figure), and can wind the intermediate transfer film 108.

One terminal of the intermediate transfer film 108 is wound around the feed roll 109. The intermediate transfer film 108 is fed from the feed roll 109 sequentially at image formation. The intermediate transfer film 108 wound around the feed roll 109 has its image-receiving layer side facing outward. The intermediate transfer film 108 fed from the feed roll 109 is sequentially wound around the winding roll 111 in the direction indicated by an arrow B during image formation.

The intermediate transfer film 108 between the feed roll 109 and the winding roll 111 is in contact with the base material side of the intermediate transfer film 108, and is stretched at a predetermined tension by the tension roll 115, tension roll 116, heating roll 110, and peeling roll 114 disposed in that order from the feed roll 109 to the winding roll 111.

The heating roll 110 contains a heat source 113. A pressure roll 112 is disposed to press the heating roll 110 with the intermediate transfer film 108 therebetween. The heating roll 110 and the pressure roll 112 constitute the heat-pressing unit. A sheet-shaped recording medium cut into a predetermined size, which is fed by a conveying unit from a recording medium-feeding tray 117 placed outside the chassis 101 (not shown in the Figure) in the direction indicated by an arrow C (horizontal direction), can pass through the portion between the pressure roll 112 and the intermediate transfer film 108 (nip portion). When the recording medium passes the nip portion, the recording medium and the intermediate transfer film 108 are stacked, and, almost at the same time, the toner image is fixed and a lamination is formed.

The pressure roll 112 may be retractably configured such that the pressure roll 112 comes into pressure-contact with the heating roll 110 at a predetermined timing. In an exemplary embodiment, the pressure roll 112 is retracted to the stand-by position so that the heating roll 110 and the pressure roll 112 are separated from each other when toner images in the respective colors are formed on the intermediate transfer film 108, and the pressure roll 112 is moved to a position at which the pressure roll 112 presses the heating roll 110 at the time the recording medium is fed from the recording medium-feeding tray 117 to the heat-pressing unit after completion of the color toner image formation on the intermediate transfer film 108. The pressure roll 112 may be configured to have a heat source inside. The heat-pressing unit may be a heat-roll fixing device used in a conventional image-forming apparatuses.

A small-diameter peeling roll 114 (as the peeling unit) is disposed on the heating roll 110 side of the feeding path for the recording medium. The peeling roll 114 is located at the recording medium discharging side of the heat-pressing unit. The winding roll 111 disposed such that the intermediate transfer film 108 stretched between the winding roll 111 and the peeling roll 114 is at an angle of approximately 70° relative to traveling direction for the recording medium. In such a case, when a rigid recording medium such as a plastic sheet is used, a pulling force is applied to the base material side of the laminate formed by the heat-pressing unit, while the recording medium itself is hard to deform owing to its rigidity even when pulled toward the base material side. Therefore, peeling occurs between the image-receiving layer and the base material. If the rigidity of the recording medium is small, deformation of the recording medium toward the base material side can be prevented, for example by sucking the recording medium side of the laminate.

The peeling unit may be a peeling blade that is inserted between the image-receiving layer and the base material of the laminated film, or a combination of the peeling blade and the peeling roll described above.

Hereinafter, a specific configuration of the four image-forming sections will be described, taking the image-forming section 102Y as a specific example. The image-forming section 102Y has a photoreceptor 103Y, a primary charger 104Y, an LED array 105Y, and a developing device 106Y. The photoreceptor 103Y is in contact with the image-receiving layer side of the intermediate transfer film 108, and is rotationally driven by a driving unit (not shown in the Figure) at a predetermined speed along the direction indicated by an arrow A. In addition, a primary charger 104Y, an LED array 105Y, a developing device 106Y, and an electrification roll 107Y are disposed in that order on the circumference of the photoreceptor 103Y along the direction indicated by the arrow A. An electrification roll 107Y is disposed to face the photoreceptor 103Y with the intermediate transfer film 108 therebetween.

The photoreceptor 103Y is not particularly limited, and may be selected from known photoreceptor drums. The photoreceptor 103Y may have a single-layer structure, or a multilayer structure whose layers have separate functions. The material of the photoreceptor 103Y may be an inorganic material such as selenium or amorphous silicon or an organic material.

The developing device 106Y forms an insulating color toner image on the photoreceptor 103Y Any known developing device that satisfies this purpose may be used. Examples of such devices include known developing devices that deposit toner on an electrophotographic photoreceptor by using Corotron, brush, or the like. As an alternative, the developing device 106Y may form a toner image on the photoreceptor 103Y by using a toner that is mixed with a known carrier and charged. For example, known devices such as that described in JP-A No. 63-58374 may be used. Yet alternatively, a color image may be formed by using a developing device that uses a one-component developer not using a carrier.

The color toner used in the developing device 106Y is insulating particles containing at least a binder resin and a colorant. A yellow toner is used in the developing device 106Y, and cyan, magenta, and black toners are used in the developing devices of the other image-forming sections. The composition, average diameter, and others of the color toners are selected appropriately from the ranges of the common known toners.

A yellow (Y)-colored toner image is formed in the image-forming section 102Y as follows:

First, the surface of the photoreceptor 103Y is charged uniformly to a predetermined electric potential by a primary charger 104Y such as an electrification roll. Thereafter, the surface of the photoreceptor 103Y is exposed to light emitted from the LED array 105Y according to the half tone image (raster data) corresponding to an input image signal, so that an electrostatic latent image is formed. The electrostatic latent image formed on the photoreceptor 103Y is developed by the developing device 106Y (as the developing unit) containing a toner in the corresponding color, so that a yellow (Y)-colored toner image is formed. The yellow (Y)-colored toner image is transferred from the photoreceptor 103Y surface onto the intermediate transfer film 108 surface by the electrification roll 107Y (as the primary transfer unit) in the contact area between the photoreceptor 103Y and the intermediate transfer film 108. The surface of the photoreceptor 103Y after completion of the transfer is cleaned as needed by a cleaning device (not shown in the Figure) so as to remove residual toner and the like. The same toner-image formation is conducted in the other image-forming sections 102K, 102C, and 102M, except that the color of the toner to be used is different.

The toner images in the respective colors thus formed in the image-forming sections 102K, 102C, 102M, and 102Y are sequentially subjected to primary transfer onto the intermediate transfer film 108 by the electrification rolls 107K, 107C, 107M, and 107Y (as primary transfer units) in the order of black, cyan, magenta, and yellow, such that the toner images in the respective colors are stacked. As a result, a color toner image is formed on the intermediate transfer film 108.

The stack of the toner images in the four colors transferred onto the surface of the intermediate transfer film 108 is further conveyed in the direction indicated by the arrow B toward the position of the heat-pressing unit. At the nip portion, the toner images are fixed, as well as the intermediate transfer film 108 is laminated on the recording medium. After passing through the nip portion, the base material of the laminate is peeled off the image-receiving layer by the peeling roll 114. The recording medium whose entire image-forming surface is covered with the image-receiving layer is discharged to outside of the chassis 101 by a conveying unit (not shown in the Figure). On the other hand, only the base material region of the intermediate transfer film 108 is wound around the winding roll 111.

In this way, it is possible to obtain uniform glossiness on the entire image-forming surface regardless of the kind of the recording medium used in image formation. In the image-forming apparatus 100 shown in FIG. 1, generation of toner offset can also be prevented since the heating roll 110 does directly contact with the toner image. If the recording medium used for image formation has been cut into the size of the final product, recording media having images thereon can be produced in large quantity at high speed without cutting the recording media after image formation.

When the fixing and the forming of a laminate are conducted by the heat-pressing unit after the toner images are transferred and stacked on the intermediate transfer film 108, image deterioration and irregular registration may occur. In order to prevent occurrence of such problems, it is possible to install a temporary fixing unit that temporarily fix the toner image on the intermediate transfer film 108 stretched between the tension roll 116 and the heating roll 110. As the temporary fixing unit, it is possible to install a contact or non-contact heating unit on the base material side and/or the image-receiving layer side of the intermediate transfer film 108 stretched between the tension roll 116 and the heating roll 110. For example, a heating roll for temporary fixing may be disposed such that the heating roll contacts the base material side of the intermediate transfer film 108.

Figure 3:
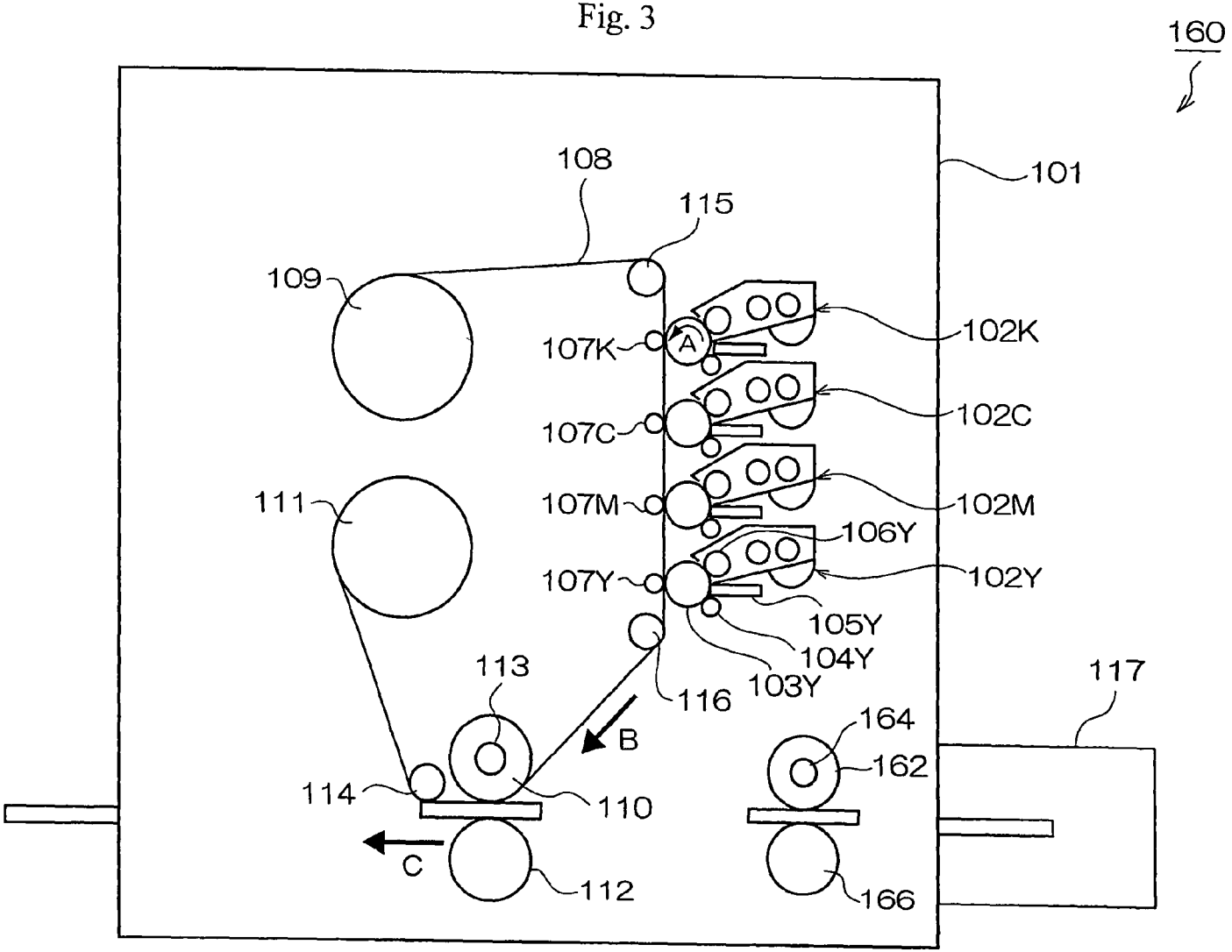
FIG. 3 is a schematic view illustrating the configuration of another example of the image-forming apparatus according to an aspect of the invention.

On the other hand, the apparatus shown in FIG. 3 of JP-A No. 2005-227377 is an example of conventional image-forming apparatuses that form an image on an intermediate transfer film having an image-receiving layer, laminate it on a recording medium, and then peel the intermediate transfer film off the recording medium to transfer only the image onto the recording medium.

Use of such an apparatus enables easy image formation on a recording medium such as plastic sheet. However, the glossiness on the image-forming surface becomes uneven since the image region and the non-image region are not covered with the image-receiving layer. In a mass production of recording media cut into a predetermined size having an image formed thereon, it has been necessary to form an image and conduct forming of a laminate and peeling by using a large-sized intermediate transfer film and recording medium (up to approximately 320×450 mm), and then cut the large-sized recording medium having the image formed thereon into pieces of a predetermined size. In addition, a positioning unit is required upon stacking the recording medium and the intermediate transfer film before forming of a laminate, and a heating unit for forming of a laminate is required in addition to the heating unit for fixing the image, whereby the production steps and the apparatus tend to be more complicated.

However, the image-forming apparatus according to an aspect of the invention shown in FIG. 1 can overcome all of the problems above.

Hereinafter, another embodiment of the image-forming apparatus according to an aspect of the invention will be described with reference to drawings.

Embodiment 2

Figure 2:
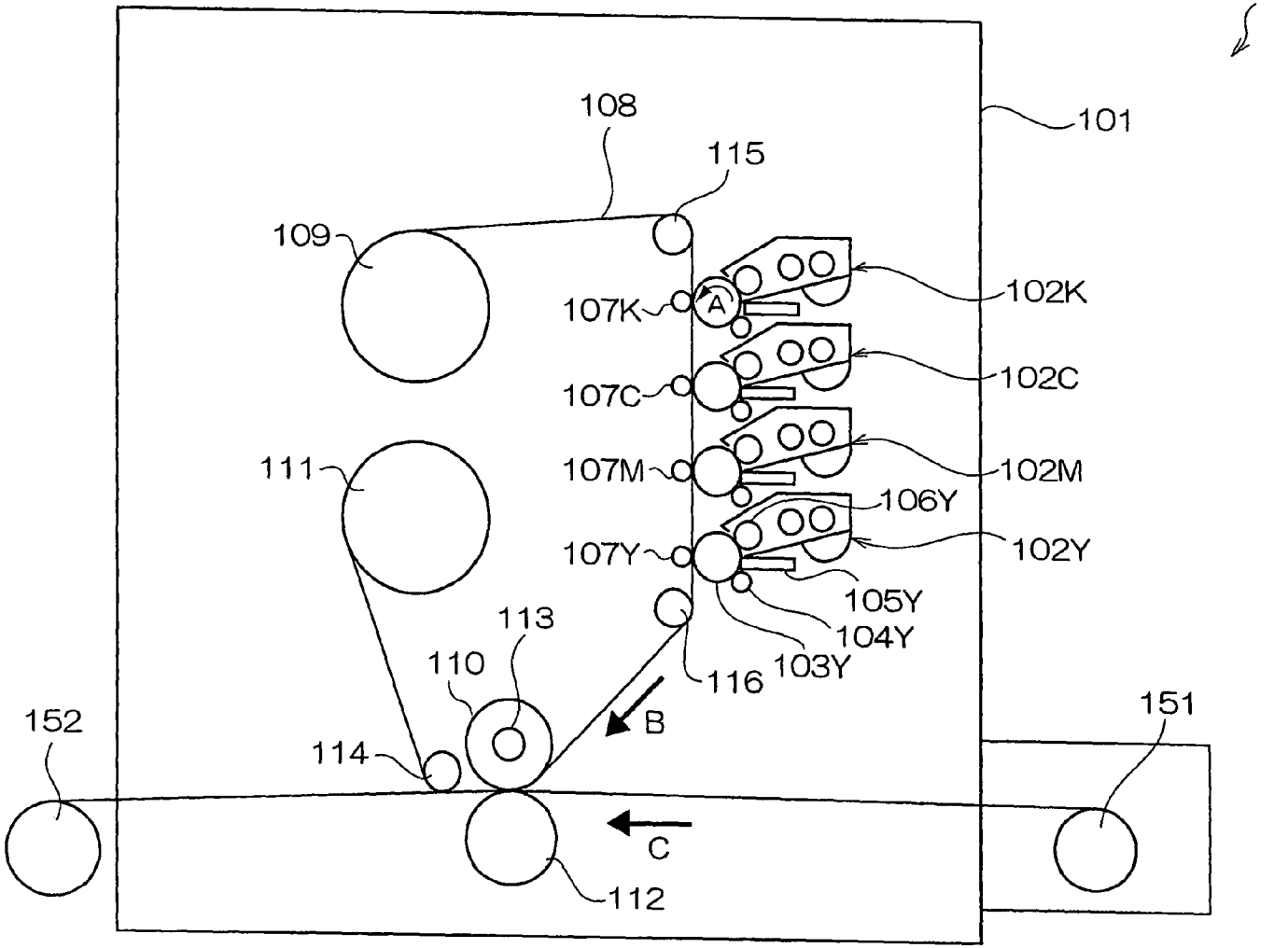
FIG. 2 is a schematic view illustrating the configuration of another example of the image-forming apparatus according to an aspect of the invention.

FIG. 2 is a schematic view illustrating the configuration of another example of the image-forming apparatus according to an aspect of the invention. In FIG. 2, 150 represents an image-forming apparatus; 151 represents a recording medium feed roll; and 152 represents a recording medium winding roll; and the units indicated by the other reference characters are the same as those shown in FIG. 1.

The image-forming apparatus 150 shown in FIG. 2 uses a belt-shaped recording medium as the recording medium, and a recording medium feed roll 151 is installed instead of the recording medium-feeding tray 117 in the image-forming apparatus 100 shown in FIG. 1, and also, a recording medium winding roll 152 connected to a driving source (not shown in Figure) is installed to the recording medium discharging side of the heat-pressing unit. The recording medium is stretched by the recording medium feed roll 151 and the recording medium winding roll 152 so that it passes through between the pressure roll 112 and the intermediate transfer film 108. The image formation is carried out while the recording medium is sequentially wound around the recording medium winding roll 152.

In this way, uniform glossiness in the entire image-forming surface can be achieved regardless of the kind of the recording medium used in image formation. In the image-forming apparatus 100 shown in FIG. 2, occurrence of toner offset can also be prevented since the heating roll 110 does not directly contact with the toner image. It is also possible to obtain a recording medium having a belt-shaped image formed thereon. A temporary fixing unit may be provided in the image-forming apparatus 150 shown in FIG. 2, similarly to the image-forming apparatus 100 shown in FIG. 1.

Yet another exemplary embodiment of the image-forming apparatus according to an aspect of the invention will be described with reference to drawings.

Embodiment 3

FIG. 3 is a schematic view illustrating the configuration of yet another example of the image-forming apparatus according to an aspect of the invention. In FIG. 3, 160 represents an image-forming apparatus; 162 represents a heating roll; 164 represents a heat source; and 166 represents a pressure roll; and the units indicated by the other reference characters are the same as those shown in FIG. 1.

The image-forming apparatus 160 shown in FIG. 3 is obtained by providing a preheating unit on the traveling route for the recording medium from the recording medium-feeding tray 117 to the heat-pressing unit having the heating roll 110 and pressure roll 112 in the image-forming apparatus 100 shown in FIG. 1.

The preheating unit comprises a heating roll 162 containing a heat source 164, and a pressure roll 166 facing the heating roll 162. The recording medium is preheated by being passed through between the heating roll 162 and the pressure roll 166 in the direction indicated by an arrow C during image formation. A known fixing device may be used as the preheating unit having a pair of rolls.

By using the image-forming apparatus 160 shown in FIG. 3, fixing defects can be prevented easily even when a thick recording medium having a larger heat capacity is used. This is because the recording medium is conveyed to the heat-pressing unit and the image is fixed after the recording medium is preheated by the preheating unit.

In addition to the elements described above, the image-forming apparatus according to an aspect of the invention may further comprise a cooling unit that cools the laminate after heating and pressing by the heat-pressing unit so that the cooling process described above can be conducted, as necessary. The cooling unit comprises at least a pair of members whose surfaces facing each other are planar. The cooling of the laminate with the cooling unit is conducted while the laminate is sandwiched between the pair of members.

The "pair of members" refers to members having a function of cooling the laminate by removing heat from the heated laminate while the shape of the laminate is maintained flat through direct or indirect contact with the laminate at the time of the cooling of the laminate. The pair of members may be simple plate-shaped members, or belts that form flat surfaces by being stretched by rolls. The pair of members may consist of a material having high thermal conductance, and may have a structure having high heat radiation property. For example, members made of a metal having a heat radiation fin or a liquid cooling mechanism can be utilized. The cooling unit may have an air cooling fan or the like for facilitating the cooling of the pair of members, which receive heat from the laminate.

An image-forming apparatus having the cooling unit may have a device that has at least the functions of the heat-pressing unit and the cooling unit.

The device having at least the functions of the heat-pressing unit and the cooling unit may be a device that comprises at least:

a heating roll that contacts a surface of the intermediate transfer film at a side at which the base material is provided, and stretches the intermediate transfer film;

an endless belt;

a pressure roll that stretches the endless belt and is located to face the heating roll such that the intermediate transfer film and the endless belt come into pressure contact with each other to form a pressure-contact region;

a tension roll that stretches the endless belt together with the pressure roll such that the outer surface of the endless belt faces the surface of the intermediate transfer film at the image-receiving layer side, the intermediate transfer film being conveyed toward the downstream direction of the rotation direction of the heating roll; and a pair of cooling members respectively contacting a surface of the intermediate transfer film at a side at which the base material is provided and the inner surface of the endless belt such that the intermediate transfer film and the endless belt come into pressure contact with each other along the region at which a surface of the intermediate transfer film at a side at which the image-receiving layer is provided and the outer surface of the endless belt face each other, wherein the surfaces of the cooling member respectively contacting the surface of the intermediate transfer film at the side at which the base material is provided and the inner surface of the endless belt are planar. The pressure roll may have a heat source inside so that the pressure roll has also a function as the heating roll.

Embodiment 4

Figure 4:
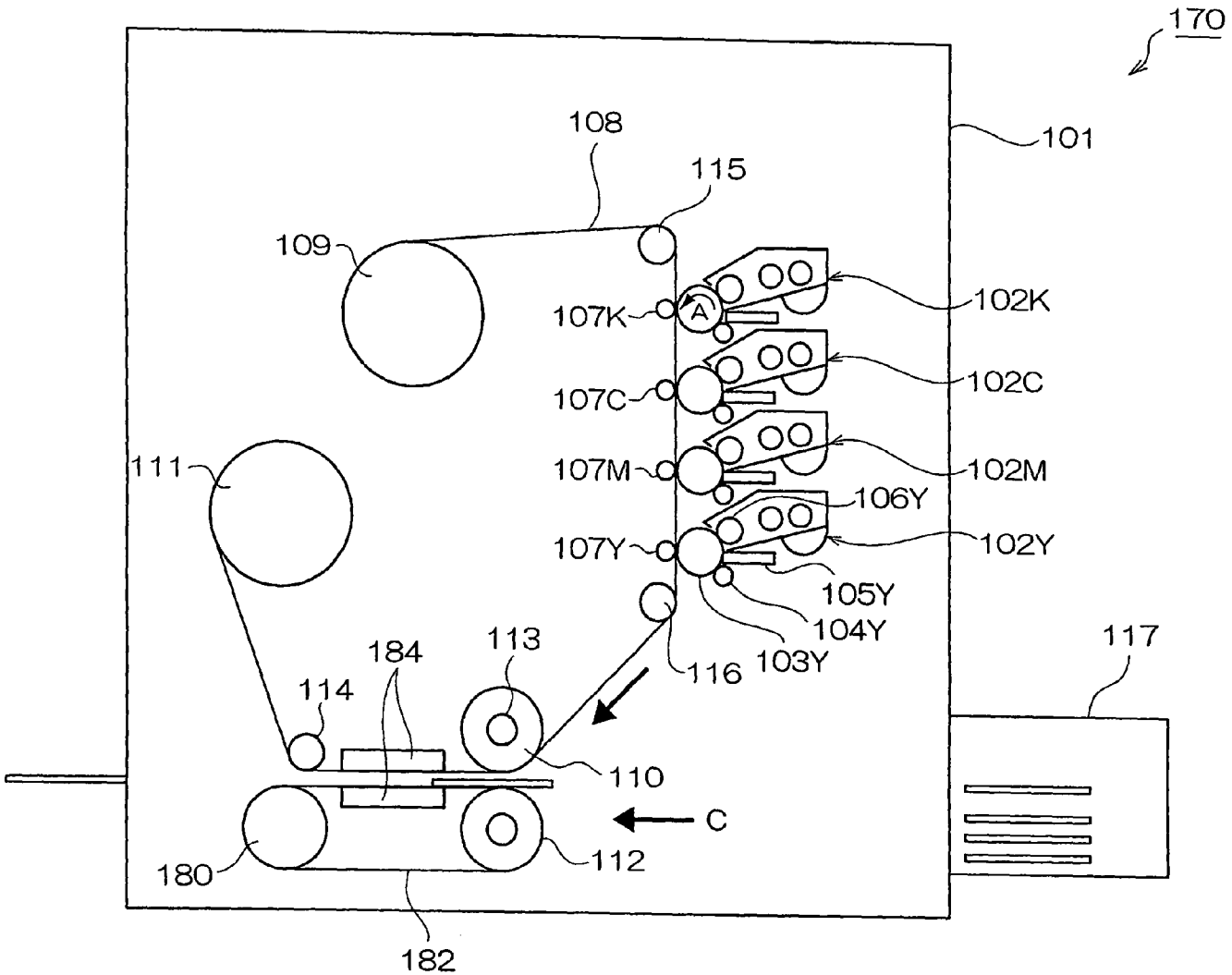
FIG. 4 is a schematic view illustrating the configuration of another example of the image-forming apparatus according to an aspect of the invention.

FIG. 4 is a schematic diagram illustrating another example of the image-forming apparatus according to an aspect of the invention. Illustrated is an example of an image-forming apparatus that has the above-described device having at least the functions of the heat-pressing unit and the cooling unit. In FIG. 4, 170 represents an image-forming apparatus, 180 represents a tension roll, 182 represents an endless belt, and 184 represents a pair of cooling members. The members represented by the other reference characters are the same as those shown in FIG. 1.

Image-forming apparatus 170 shown in FIG. 4 has the above structure in which the heat-pressing unit (heating roll 110 and pressure roll 112) of image-forming apparatus 100 shown in FIG. 1 is modified to have an additional function as the cooling unit. Since tension roll 180 is disposed to face peeling roll 114, the portion composed of heating roll 100, pressure roll 112, tension roll 180, endless belt 182, pair of cooling members 184, and peeling roll 114 has a substantially integrated structure, and has also the function as the peeling unit, in addition to the functions as the heat-pressing unit and the cooling unit.

Each of cooling members 184 consists of a metal plate equipped with a cooling fin (not shown). The cooling members 184 are disposed to press endless belt 182 and intermediate transfer film 108 provided between the cooling members 184 from both sides by pressure-contact elements (not shown). Further, an air cooling fan (not shown) is provided near cooling members 184 in order to heighten the heat radiation efficiency of pair of cooling members 184. When heating roll 100 and pressure roll 112 are retractable, pair of cooling members 184 may be configured to be retractable in synchronization with pair of rolls 110 and 112.

In image-forming apparatus 170 shown in FIG. 4, the laminate formed during passage between heating roll 110 and pressure roll 112 is conveyed to a region between cooling members 184 by endless belt 182. When passing through the region, the laminate is pressed from both sides by cooling members 184, so that the heat of the laminate is transferred to cooling members 184 and thus the laminate is cooled sufficiently while maintaining the flat shape. The transfer of the heat from the laminate to cooling members 184 may be direct heat transfer, or may be indirect heat transfer via endless belt 182. Thereafter, the laminate is transferred to a region between tension roll 180 and peeling roll 114.

When image-forming apparatus 170 shown in FIG. 4 is used, the formation of the laminate by application of heat and pressure, the cooling of the laminate, and the peeling at the interface between the base material and the image-receiving layer in the laminate can be conducted successively and efficiently; therefore, plastic cards without deformation can be produced efficiently even when a plastic film that is easily deformed by heat is used as the recording medium or when the fixing is conducted at a high fixing temperature.

EXAMPLE

Hereinafter, the invention will be described specifically with reference to Examples. However, the following Examples should not be construed as limiting the invention. The "part" in the following Examples means a "part by weight".

Example 1

Image-Forming Apparatus

The image-forming apparatus used is the image-forming apparatus described above shown in FIG. 1, and the recording medium is a plastic sheet. Detailed conditions are as follows:

—Developer—

The developers used are the cyan developer, magenta developer, yellow developer, and black developer for DOCUCOLOR1255 manufactured by Fuji Xerox Co., Ltd. The volume average diameters of the toners are 7 μm.

—Recording Medium—

The recording medium used in color-image formation is a white polyvinyl chloride sheet (VINYFOIL C-4636, manufactured by Mitsubishi Plastics, Inc.) having a thickness of 760 μm that has been previously stamped into pieces of a card size (85.6 mm×54 mm).

—Amount of the Color Toners for Development and Image Signal—

The amount of the color toner in each color used for development is 0.5 mg/cm$^2$ in the region where the image signal Cin=100%. The data read by a scanner is subjected to corrections in color, gradation, and sharpness with an image-processor, to give an image signal for each color toner.

—Intermediate Transfer Film—

An intermediate transfer film in two-layer structure having a base layer (base material) and an image-receiving layer is used as the intermediate transfer film 108. The base layer used is a belt-shaped PET film whose one surface has been previously subjected to releasability imparting treatment (PET50SG-2 manufactured by Panac Co., Ltd., thickness: 50 μm, width: 54 mm, length: 5 m, surface roughness Ra of the surface which has been subjected to the releasability imparting treatment: 0.05 μm). The image-receiving layer is formed by dissolving 40 parts by weight of a coating solution containing a urethane-modified polyester resin (UR-4122 manufactured by Toyobo, solid content: 30 wt %) and 0.2 part by weight of a resistance adjustor (ELEGAN 264 WAX manufactured by NOF Corp.) in 30 parts by weight of an organic solvent (mixed solution of cyclohexanone and methylethylketone in a weight ratio of 10:90), and coating the solution, with a wire bar, on the surface of the PET film which has been subjected to the releasability imparting treatment such that the thickness of the coating after drying becomes 10 μm.

In this way, an intermediate transfer film having an image-receiving layer with a surface resistivity of $9.2\times10^{12}\Omega$ is prepared.

—Image Formation—

At image formation, a white polyvinyl chloride sheet is placed in the recording medium-feeding tray 117 such that the longitudinal direction of the sheet is the feed direction; the heating temperature of the heat-pressing unit is set at 180° C.; and the feed speed of the intermediate transfer film 108 is set at 25 mm/s.

A portrait image is formed in the central area of the white polyvinyl chloride sheet, with a margin of approximately 1 cm along the periphery (non-image region).

Example 2

Image-Forming Apparatus

The image-forming apparatus used is the image-forming apparatus described above shown in FIG. 1, and the recording medium used is a plastic sheet. Hereinafter, detailed conditions will be described.

—Developer—

The developers used are the cyan, magenta, yellow, and black developers for DOCUCOLOR1256GA manufactured by Fuji Xerox Co., Ltd. The toners have an average diameter of 7 μm.

—Recording Medium—

The recording medium used in color image formation is a white PET-G sheet (PG-WHI, manufactured by Mitsubishi Plastics, Inc.) having a thickness of 740 μm, which has been previously stamped into pieces of a card size (85.6 mm×54 mm).

—Amount of the Color Toner Used in Development and Image Signal—

The amount of each color toner used in development is 0.5 mg/cm$^2$ in the region where the image signal Cin=100%. The data read by a scanner is processed for correction in color, gradation, and sharpness in an image-processor, to give an image signal for each color toner.

—Preparation of Release Layer Coating Solution—

Ten parts by weight of a silicone hard coating agent (SHC900, manufactured by GE Toshiba Silicones, solid content 30 wt %) containing an organic silane condensate, a melamine resin, and an alkyd resin, 0.9 part by weight of a resistance adjustor PIONINE B144 V (manufactured by Takemoto Oil & Fat Co., Ltd.) are added to 30 parts by weight of a mixed solution of cyclohexanone and methylethylketone in a ratio of 10:90 weight ratio; and the resultant mixture is stirred thoroughly, to form a release layer coating solution.

—Preparation of Image-Receiving Layer Coating Solution 1—

40 parts by weight of a polyester resin (manufactured by Toyobo Co. Ltd, VYLON 885), 60 parts by weight of an organic solvent (2-butanone), and 0.2 part by weight of a resistance adjustor (Elegan 264WAX, manufactured by NOF Corp.) are mixed and stirred to dissolve the components sufficiently, so that an image-receiving-layer coating solution 1 is obtained.

—Preparation of Intermediate Transfer Film—

The release layer coating solution is coated on one surface of a PET film (LUMIRROR S10 manufactured by Toray Industries, Inc, thickness: 75 μm) as a base material with a wire bar, and is dried at 120° C. for 30 seconds, to form a release layer having a thickness of 0.5 μm. The surface resistivity thereof is $4.7\times10^{11}\Omega$.

The image-receiving layer coating solution 1 is coated on the surface having the release layer with a wire bar, and is dried at 120° C. for 60 seconds, to form an image-receiving layer having a thickness of 10 μm. The surface resistivity thereof is $2.8\times10^{10}\Omega$. A belt-shaped intermediate transfer film having a width of 54 mm and a length of 10 m is prepared therefrom. The center line average roughness Ra on image-receiving layer is 2 μm —Image Formation—

At image formation, a white PET-G sheet is placed in the recording medium-feeding tray 117 such that the longitudinal direction of the sheet is the feed direction; the heating temperature of the heat-pressing unit is set at 200° C.; and the feed speed of the intermediate transfer film 108 is set at 24 mm/s.

A portrait image is formed in the central area of the white PET-G sheet, with a margin of approximately 1 cm along the periphery (non-image region).

Example 3

Preparation of Intermediate Transfer Film

The release layer coating solution used in Example 2 is coated on both surfaces of a PET film (LUMIRROR T60 manufactured by Toray Industries, Inc, thickness: 50 μm) as a base material with a wire bar and dried at 120° C. for 30 seconds, to form a release layer having a thickness of 0.5 μm. The surface resistivity thereof is $4.7\times10^{11}\Omega$. Then, the image-receiving layer coating solution 1 is coated on one of the surfaces having the release layers with a wire bar and dried at 120° C. for 60 seconds, to form an image-receiving layer having a thickness of 9 μm. The surface resistivity thereof is $2.6\times10^{10}\Omega$. The peeling strength between the release layer and the image-receiving layer is 0.34 N/cm (35 gf/cm). A belt-shaped intermediate transfer film is prepared therefrom in the same manner as Example 1.

—Image Formation—

An image is formed in the same manner as Example 2.

Example 4

Image-Forming Apparatus

The image-forming apparatus used is the image-forming apparatus described above shown in FIG. 1, and the recording medium used is a plastic sheet. Hereinafter, detailed conditions will be described.

—Developer—

The developers used are cyan, magenta, yellow, and black developers for DOCUCOLOR1256GA manufactured by Fuji Xerox Co., Ltd. The toners have an average diameter of 7 μm.

—Recording Medium—

The recording medium used in color image formation is a white polyvinyl chloride sheet (VINYFOIL C-4636 manufactured by Mitsubishi Plastics, Inc.) having a thickness of 760 μm, which has been previously stamped into pieces of a card size (85.6 mm×54 mm).

—Amount of Color Toner Used in Development and Image Signal—

The amount of each color toner used in development is 0.5 $mg/cm^2$ in the region where the image signal Cin=100%. The data read by a scanner is processed for correction in color, gradation, and sharpness in an image-processor, to give an image signal for each color toner.

—Intermediate Transfer Film—

An intermediate transfer film in two-layer structure having a base layer (base material) and an image-receiving layer is used as the intermediate transfer film 108. The base layer used is a belt-shaped film (SG-2 manufactured by Panac Co., Ltd, width: 54 mm, length: 5 m, surface roughness Ra of the surface which has been subjected to releasability imparting treatment: 20 μm) obtained by subjecting one surface of a PET film (LUMIRROR MATTE B manufactured by Kimoto Co., Ltd, thickness: 50 μm) to a releasability imparting treatment. The image-receiving layer is formed by dissolving 40 parts by weight of a coating solution containing a urethane-modified polyester resin (UR-4122, manufactured by Toyobo Co., Ltd, solid content: 30 wt %) in 30 parts by weight of a mixed organic solvent (cyclohexanone and methylethylketone in a ratio of 10:90 by weight), and coating the solution on the surface of the PET film which has been subjected to the releasability imparting treatment with a wire bar such that the thickness of the coating after drying becomes 10 μm.

—Image Formation—

At image formation, a white polyvinyl chloride sheet is placed in the recording medium-feeding tray 117 such that the longitudinal direction of the sheet is the feed direction; the heating temperature of the heat-pressing unit is set at 180° C.; and the feed speed of the intermediate transfer film 108 is set at 25 mm/s.

A portrait image is formed in the central area of the white polyvinyl chloride sheet, with a margin of approximately 1 cm along the periphery (non-image region).

Example 5

An image is formed in the same manner as Example 1, except that an image-forming apparatus that has the same configuration to the apparatus used in Example 1 except for additionally having a preheating unit as shown in FIG. 3 is used in place of the image-forming apparatus used in Example 1, and except that the heating temperature of the preheating unit is set at 100° C.

Example 6

Image-Forming Apparatus

The image-forming apparatus used is the image-forming apparatus described above shown in FIG. 1, and the recording medium used is a plastic sheet. Hereinafter, detailed conditions will be described.

—Developer—

The developers used are cyan, magenta, yellow, and black developers for DOCUCOLOR 1256GA manufactured by Fuji Xerox Co., Ltd. The toner have an average diameter of 7 μm.

—Recording Medium—

The recording medium used in color image formation is a white PET-G sheet (PG-WHI, manufactured by Mitsubishi Plastics, Inc.) having a thickness of 740 μm, which has been previously stamped into pieces of a card size (85.6 mm×54 mm).

—Amount of the Color Toner Used in Development and Image Signal—

The amount of each color toner used in development is 0.5 $mg/cm^2$ in the region where the image signal Cin=100%. The data read by a scanner is processed for correction in color, gradation, and sharpness in an image-processor, to give an image signal for each color toner.

—Preparation of Release Layer Coating Solution—

Ten parts by weight of a silicone hard coating agent (manufactured by GE Toshiba Silicones Co., Ltd, SHC900, solid content 30 wt %) containing an organic silane condensate, a melamine resin, and an alkyd resin, 0.2 parts by weight of a resistance adjustor PIONINE B144 V (manufactured by Takemoto Oil & Fat Co., Ltd.), and 1.5 parts by weight of a filler (TOSPEARL 130, manufactured by GE Toshiba Silicones Co., Ltd.) are added to 30 parts by weight of a mixed solution of cyclohexanone and methylethylketone in a weight ratio of 10:90; and the mixture is agitated thoroughly, to form a release layer coating solution.

—Preparation of Image-Receiving Layer Coating Solution 2—

40 parts by weight of a polyester resin (VYLON 885, manufactured by Toyobo Co., Ltd), 60 parts by weight of an organic solvent (2-butanone), and 0.3 part by weight of a resistance adjustor (ELEGAN 264 WAX manufactured by NOF Corp.) are mixed and dissolved while agitated thoroughly, to give an image-receiving layer coating solution 2.

—Preparation of Intermediate Transfer Film—

The release layer coating solution is coated on both surfaces of a PET film (LUMIRROR S10 manufactured by Toray Industries, Inc, thickness: 50 μm) as a base material with a wire bar, and is dried at 120° C. for 30 seconds, to form a release layer having a thickness of 0.5 μm. The surface resistivity thereof is $3.8\times10^{10}\Omega$.

The image-receiving-layer coating solution 2 is coated on one of the surfaces with a wire bar and dried at 120° C. for 120 seconds, to form an image-receiving layer having a thickness of 8 μm. The surface resistivity thereof is $2.6\times10^{10}\Omega$.

The film obtained is cut into a belt-shaped film with a width of 54 mm and a length of 10 m, so that an intermediate transfer film is obtained.

—Image Formation—

At image formation, a white PET-G sheet is placed in the recording medium-feeding tray 117 such that the longitudinal direction of the sheet is the feed direction; the heating temperature of the heat-pressing unit is set at 180° C.; and the feed speed of the intermediate transfer film 108 is set at 24 mm/s.

A portrait image is formed in the central area of the white PET-G sheet, with a margin of approximately 1 cm along the periphery (non-image region).

Example 7

An intermediate transfer film is prepared in the same manner as Example 6, except that a PEN film (NEOTEX manufactured by Teijin DuPont Films Japan Limited, thickness: 12 μm) is used as the base material and the filler used in the release layer coating solution of Example 6 is replaced with 1.5 parts by weight of a filler (TOSPEARL 145, manufactured by GE Toshiba Silicones Co., Ltd). The surface resistivity of the surface having the release layer is $4.7\times10^{11}\Omega$; the surface resistivity of the surface having the image-receiving layer is $2.8\times10^{10}\Omega$; and the center line average roughness (Ra) of the surface having the image-receiving layer is 2.5 μm.

Then, an image is formed in the same manner as Example 6, except that this intermediate transfer film is used.

Example 8

An intermediate transfer film is prepared in the same manner as Example 6, except that a PEN film (NEOTEX manufactured by Teijin DuPont Films Japan Limited, thickness: 25 μm) is used as the base material and the filler used in the release layer coating solution of Example 6 is replaced with 2 parts by weight of a filler (TOSPEARL 3120, manufactured by GE Toshiba Silicones Co., Ltd).

The surface resistivity of the surface having the release layer is $4.7\times10^{11}\Omega$, and the center line average roughness (Ra) is 5 μm. The surface resistivity of the surface having the image-receiving layer is $2.8\times10^{10}\Omega$.

Then, an image is formed in the same manner as Example 6, except that this intermediate transfer film is used.

Example 9

An intermediate transfer film is prepared in the same manner as Example 6, except that a PEN film (NEOTEX manufactured by Teijin DuPont Films Japan Limited, thickness: 38 μm) is used as the base material.

The surface resistivity of the surface having the release layer is $4.7\times10^{11}\Omega$, and the surface resistivity of the surface having the image-receiving layer is $2.8\times10^{10}\Omega$.

Then, an image is formed in the same manner as Example 6, except that this intermediate transfer film is used.

Example 10

An intermediate transfer film is prepared in the same manner as Example 6, except that a para-aromatic polyamide film (MICTRON manufactured by Toray Industries, Inc thickness: 12 μm) is used as the base material.

The surface resistivity of the surface having the release layer is $4.7\times10^{11}\Omega$, and the surface resistivity of the surface having the image-receiving layer is $9.8\times10^{9}\Omega$.

Then, an image is formed in the same manner as Example 6, except that this intermediate transfer film is used.

Example 11

An intermediate transfer film is prepared in the same manner as Example 6, except that a PEN film (NEOTEX manufactured by Teijin DuPont Films Japan Limited, thickness: 12 μm) is used as the base material.

The surface resistivity of the surface having the release layer is $4.7\times10^{11}\Omega$, and the surface resistivity of the surface having the image-receiving layer is $1.2\times10^{10}\Omega$.

Then, an image is formed in the same manner as Example 6, except that this intermediate transfer film is used.

Example 12

An intermediate transfer film is prepared in the same manner as Example 6, except that a polyimide film (KAPTON, manufactured by Du Pont-Toray Co., Ltd, thickness: 12.5 μm) is used as the base material.

The surface resistivity of the surface having the release layer is $4.7\times10^{11}\Omega$, and the surface resistivity of the surface having the image-receiving layer is $2.8\times10^{10}\Omega$.

Then, an image is formed in the same manner as Example 6, except that this intermediate transfer film is used.

Example 13

An intermediate transfer film is prepared in the same manner as Example 6, except that a polyimide film (KAPTON, manufactured by Du Pont-Toray Co., Ltd, thickness: 37.5 μm) is used as the base material and the thickness of the release layer is changed to 1 μm.

The surface resistivity of the surface having the release layer is $1.7\times10^{11}\Omega$, and the surface resistivity of the surface having the image-receiving layer is $2.8\times10^{10}\Omega$.

Then, an image is formed in the same manner as Example 6, except that this intermediate transfer film is used.

Example 14

An intermediate transfer film is prepared in the same manner as Example 6, except that a polyimide film (UPILEX-S, manufactured by Ube Industries Ltd, thickness: 25 μm) is used as the base material and the thickness of the release layer is changed to 1 μm.

The surface resistivity of the surface having the release layer is $4.7\times10^{11}\Omega$, and the surface resistivity of the surface having the image-receiving layer is $3.0\times10^{10}\Omega$.

Then, an image is formed in the same manner as Example 6, except that this intermediate transfer film is used.

Example 15

An intermediate transfer film is prepared in the same manner as Example 6, except that a polyphenylene sulfide (PPS) film (TORELINA 3000, manufactured by Toray Industries, Inc, thickness: 12 μm) is used as the base material and the thickness of the image-receiving-layer is changed to 9 μm.

The surface resistivity of the surface having the release layer is $4.7\times10^{11}\Omega$, and the surface resistivity of the surface having the image-receiving layer is $3.3\times10^{10}\Omega$.

Then, an image is formed in the same manner as Example 6, except that this intermediate transfer film is used.

Example 16

An intermediate transfer film is prepared in the same manner as Example 6, except that a polyphenylene sulfide (PPS) film (TORELINA 3000, manufactured by Toray Industries, Inc, thickness: 25 μm) is used as the base material.

The surface resistivity of the surface having the release layer is $4.7\times10^{11}\Omega$, and the surface resistivity of the surface having the image-receiving layer is $2.8\times10^{10}\Omega$.

Then, an image is formed in the same manner as Example 6, except that this intermediate transfer film is used.

Example 17

An intermediate transfer film is prepared in the same manner as Example 6, except that a polyphenylene sulfide (PPS) film (TORELINA 3000, manufactured by Toray Industries, Inc, thickness: 38 μm) is used as the base material.

The surface resistivity of the surface having the release layer is $5.0\times10^{11}\Omega$, and the surface resistivity of the surface having the image-receiving layer is $2.8\times10^{10}\Omega$.

Then, an image is formed in the same manner as Example 6, except that this intermediate transfer film is used.

Example 18

An intermediate transfer film is prepared in the same manner as Example 6, except that a polyether imide film (SUPERIO UT-15F, manufactured by Mitsubishi Plastics, Inc., thickness: 15 μm) is used as the base material.

The surface resistivity of the surface having the release layer is $4.7\times10^{11}\Omega$, and the surface resistivity of the surface having the image-receiving layer is $2.8\times10^{10}\Omega$.

Then, an image is formed in the same manner as Example 6, except that this intermediate transfer film is used.

Example 19

An intermediate transfer film is prepared in the same manner as Example 6, except that a polyether imide film (SUMILITE FS-1400, manufactured by Sumitomo Bakelite Co., Ltd, thickness: 25 μm) is used as the base material.

The surface resistivity of the surface having the release layer is $4.7\times10^{11}\Omega$, and the surface resistivity of the surface having the image-receiving layer is $2.8\times10^{10}\Omega$.

Then, an image is formed in the same manner as Example 6, except that this intermediate transfer film is used.

Example 20

An intermediate transfer film is prepared in the same manner as Example 6, except that a polyether imide film (SUMILITE FS-1400, manufactured by Sumitomo Bakelite Co., Ltd, thickness: 38 μm) is used as the base material.

The surface resistivity of the surface having the release layer is $4.8\times10^{11}\Omega$, and the surface resistivity of the surface having the image-receiving layer is $2.8\times10^{10}\Omega$.

Then, an image is formed in the same manner as Example 6, except that this intermediate transfer film is used.

Comparative Example 1

Preparation of Image-Receiving Layer Coating Solution 3

Ten parts by weight of a silicone hard coating agent (SHC900, manufactured by GE Toshiba Silicones Co., Ltd, solid content: 30 wt %) containing an organic silane condensate, a melamine resin, and an alkyd resin, 0.002 part by weight of polydimethylsiloxane fine particles (TP145, manufactured by GE Toshiba Silicones Co., Ltd, volume-average particle diameter: 4.5.mu.m) as a filler, and 0.2 part by weight of an antistatic agent, PIONINE B144 V (manufactured by Takemoto Oil & Fat Co., Ltd.) are added to 30 parts by weight of a mixed solution of cyclohexanone and methylethylketone in a weight ratio of 10:90; and the mixture is agitated thoroughly, to give an image-receiving layer coating solution 3.

—Preparation of Intermediate Transfer Film—

An image-receiving layer having a thickness of 1 μm is formed on one surface of a PET film (LUMIRROR 100T60, manufactured by Toray Industries, Inc, thickness: 100 μm) as a base material, by coating the image-receiving-layer coating solution 3 with a wire bar and drying it at 120° C. for 30 seconds. The base material is then cut into pieces of the A4 size (210 mm×297 mm), to give a sheet-shaped intermediate transfer film.

The same portrait image as that in Example 1 is formed on the image-receiving layer of the intermediate transfer film by using an image-forming apparatus (color copying machine DOCUCOLOR 1255CP manufactured by Fuji Xerox Co., Ltd.). The portrait image is formed in the ratio of one image per area of 85.6 mm×54 mm with a peripheral margin of approximately 1 cm in width (non-image region).

—Recording Medium—

The recording medium used in color-image formation is a white polyvinyl chloride sheet (manufactured by Mitsubishi Plastics, Inc., VINYFOIL C-4636) having a thickness of 760 μm, which has been previously stamped into the A4 size.

—Forming of a Laminate, Peeling and Stamping—

The intermediate transfer film having an image fixed thereon is laid on one side of the white polyvinyl chloride sheet such that the image surface of the intermediate transfer film contacts the white polyvinyl chloride sheet. The film and the sheet are bonded to each other by using a laminator (LAMIPACKER LPD 3206 City manufactured by Fujipla Inc.) at 160° C. and a feed speed of 0.3 m/min (5 mm/s), and then cooled to normal temperature. The intermediate transfer film is peeled off the white polyvinyl chloride sheet, leaving only the image transferred onto the white polyvinyl chloride sheet. Then, the sheet is stamped into pieces of a size of 85.6 mm×54 mm such that the region having the portrait image is located at the center.

(Evaluation)

—Evaluation of Glossiness—

The surface glossiness of each of the recording media having an image thereon obtained in Examples 1 to 20 and Comparative Example 1 is evaluated by visual observation and by using a glossimeter (GM-26D manufactured by Murakami Color Research Laboratory Co., Ltd.). The results revealed that uniform glossiness is obtained over both the image region and the non-image (margin) region on the image-forming surface and the measured value obtained by the glossimeter is also almost constant over the entire surface in Example 1, while there is distinct difference in gloss appearance between the image and non-image regions, and the measured glossiness value also varies (100 in the image region, 70 in the non-image region) in Comparative Example 1.

In Example 4, a base material is used in which the surface that has been subjected to releasability imparting treatment has a surface roughness (center line average roughness) Ra of 20 μm, and the entire image-forming surface is matte-finished. In contrast, in Examples 1 to 3 and 5 to 20, in which the surface roughness (center line average roughness) Ra of the base material is several μm or less, it is possible to make the entire image-forming surface highly glossy or relatively highly glossy.

—Evaluation of the Satin-Finished Pattern on Image-Forming Surface—

As for the samples of Examples 1 to 3, obtained by using an intermediate transfer film having a base material with a smooth surface and having an image-forming surface that is not matte-finished, the residual air that remains in the image-forming surface due to the irregularity of the surface of the recording medium is evaluated. The results are shown in Table 1.

The residual air is evaluated by visual observation. The evaluation criteria for the results shown in Table 1 are as follows:

A: Hardly any residual air bubble is observable

B: Minute residual air bubbles are observable in a part only when observed carefully.

C: Many minute residual air bubbles are observable when observed carefully.

D: Air bubbles are easily observable regardless of their sizes.

TABLE 1

| | Thickness of base material (μm) | Evaluation of residual air |
|---|---|---|
| Example 1 | 50 | A |
| Example 2 | 38 | A |
| Example 3 | 25 | A |

—Evaluation of Fixability—

The results of the evaluation on the difference in fixability caused by the presence of absence of preheating determined by using the samples of Examples 1 and 5 are shown in the following Table 2.

The fixability shown in Table 2 is evaluated by the following method: An X-shaped scar with a length of approximately 40 mm that penetrates the image to the base material of the recording medium is formed in the image region of the recording medium with a cutter knife; a mending tape 810 manufactured by Sumitomo 3M is placed thereon, pressed sufficiently to be adhered; and 2 minutes later, the mending tape is peeled off instantaneously in the vertical direction. Evaluation criteria for the results shown in Table 2 are as follows:

A: No image peeling is observable.

B: Slight peeling is observable at the intersection of the X-shape scar

C: Partial peeling is observable at the intersection of the X-shaped scar or along the scar.

D: Peeling is observable at most regions at the intersection of the X-shape scar or along the scar.

TABLE 2

| | Preheating | Fixing efficiency |
|---|---|---|
| Example 1 | Conducted | B |
| Example 5 | Not conducted | A |

—Evaluation of Image Elongation—

The image elongation in relation to the thickness and material of the base material is evaluated using the samples of Examples 6 to 20. The results are shown in the following Table 3.

The image elongation shown in Table 3 is determined as an elongation ratio of the image formed by using the base material described in each Example, taking a line of 20 mm (in a circumferential direction) in the image transferred from a PET film having a thickness of 100 μm, which does not normally elongate, as the standard. Evaluation criteria for the results shown in Table 3 are as follows:

A: Image elongation of 0 to 0.5%

B: Image elongation of 0.5 to 2%

C: Image elongation of 2 to 5%

D: Image elongation of more than 5%

TABLE 3

| | Base material | | |
|---|---|---|---|
| | Film material | Thickness (μm) | Image elongation |
| Example 6 | PET | 50 | A |
| Example 7 | PEN | 12 | A |
| Example 8 | PEN | 25 | A |
| Example 9 | PEN | 38 | A |
| Example 10 | Aromatic polyamide | 12 | A |
| Example 11 | PEN | 12 | A |
| Example 12 | Polyimide | 12.5 | A |
| Example 13 | Polyimide | 37.5 | A |
| Example 14 | Polyimide | 25 | A |
| Example 15 | PPS | 12 | A |
| Example 16 | PPS | 25 | A |
| Example 17 | PPS | 38 | A |
| Example 18 | PEI | 15 | A |
| Example 19 | PEI | 25 | A |
| Example 20 | PEI | 38 | A |

Evaluation of Thermal Deformation of Plastic Card

Example 21

Ten plastic cards are produced continuously in the same manner as in Example 1, except that (i) the recording medium used in Example 1 is replaced with a PETG sheet (DIAFIX WHI manufactured by Mitsubishi Plastics Inc., having a glass transition temperature of 57.degree. C.) having a thickness of 760.mu.m which has been punched into a card size (85.6 mm.times.54 mm) in advance; (ii) the apparatus having a structure shown in FIG. 4 is used in place of the apparatus shown in FIG. 1; (iii) the temperature of the heat-pressing unit is set to 180.degree. C.; and (iv) the feeding velocity of the intermediate transfer film is set to 25 mm/s. Cards produced after the temperature inside the apparatus becomes almost constant are used as the cards for evaluation.

The apparatus used for evaluation has a configuration comprising an apparatus having a structure shown in Table 1 used in Example 1 to which a cooling unit including tension roll 180, endless belt 182, and a pair of cooling members 184 is added.

In the configuration, endless belt 182 is a belt having a thickness of 0.3 mm and a width of 60 mm comprising a polyimide substrate and a silicone rubber layer provided on the outer surface of the polyimide substrate. Cooling members 184 are each a metal plate made of aluminum having a thickness of 5 mm, a width of 80 mm, and a length of 40 mm. One surface of the metal plate is a flat plane, and the other surface has a heat radiation fin. Two small cooling fans having a propeller with a diameter of 40 mm are provided on the surface of the metal plate which surface is at a side at which the heat radiation fin is provided.

Example 22

Ten plastic cards are continuously produced in the same manner as in Example 21, except that the same apparatus as that used in Example 1 is used for evaluation. The settings of the temperature of the heat-pressing unit and the feeding velocity of the intermediate transfer film are the same as in Example 21. Cards produced after the temperature inside the apparatus becomes almost constant are used as the cards for evaluation.

Evaluation

Ten plastic cards obtained in Example 21 and ten plastic cards obtained in Example 22 are placed on a level block. The occurrence and degree of deformation of the plastic cards are observed visually, and are evaluated according to the following criteria. The results are shown in Table 4.

A: There is no gap between each plastic card and the level block.

B: A very minute gap is observed between the level block and some of the plastic cards. However, the distance between the surface of the plastic cards and the level block is less than 1.5 mm at every portion, and there is no practical problem.

C: A gap is observed between the level block and some or all of the plastic cards. Moreover, deformation that gives a distance of more than 1.5 mm between the plastic cards and the level block is observed, and there is a practical problem.

TABLE 4

| | Image Forming Apparatus | Evaluation of Deformation |
|---|---|---|
| Example 21 | FIG. 4 | A |
| Example 22 | FIG. 1 | B |

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments are chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

All publications, patent applications, and technical standards mentioned in this specification are herein incorporated by reference to the same extent as if each individual publication, patent application, or technical standard was specifically and individually indicated to be incorporated by reference.

What is claimed is:

1. An image-forming method comprising:

forming a toner image on the surface of an image carrier;

transferring the toner image from the surface of the image carrier onto an image-receiving layer of a belt-shaped intermediate transfer film in which the image-receiving layer is provided on a surface of a base material, wherein the thickness of the base material is approximately 50 μm or less;

superimposing the intermediate transfer film on a surface of a recording medium such that the toner image contacts the surface of the recording medium, the recording medium being a plastic film having a thickness of 100 μm to 1000 μm;

fixing the toner image by application of heat and pressure;

forming a laminate by pressure-bonding the superimposed intermediate transfer film onto the recording medium by application of heat and pressure;

peeling the base material off the image-receiving layer at the interface therebetween, so that the entire image-forming surface of the recording medium is covered with the image-receiving layer and so that the image is formed between the recording medium and the image-receiving layer; and receiving the peeled base material and winding the base material around a winding roll so that the base material accumulates around the winding roll.

2. The image-forming method according to claim 1, wherein the recording medium is sheet-shaped.

3. The image-forming method according to claim 1, wherein the recording medium is belt-shaped.

4. The image-forming method according to claim 1, wherein the image is a color image.

5. The image-forming method according to claim 1, wherein the superimposing, the fixing, and the forming of the laminate are performed substantially at the same time.

6. The image-forming method according to claim 1, wherein the method further comprises preheating the toner image transferred onto the intermediate transfer film surface so as to temporarily fix the toner image, after the transferring but before the fixing.

7. The image-forming method according to claim 1, wherein releasability is imparted to the surface of the base material at a side at which the image-receiving layer is provided.

8. The image-forming method according to claim 1, wherein the superimposing is conducted after preheating the recording medium.

9. The image-forming method according to claim 1, wherein the method further include cooling the laminate while the laminate is sandwiched between a pair of members, after the fixing and the forming of the laminate but before the peeling, and the surfaces of the members contacting the surfaces of the laminate are substantially planar.

10. The image-forming method of claim 1, wherein the thickness of the base material is substantially between 10 μm and 50 μm.

11. The image-forming method of claim 1, wherein the thickness of the base material is substantially between 18 μm and 40 μm.

12. The image-forming method of claim 1, wherein the surface resistivity at a temperature of 23° C. and a humidity of 55 RH % of at least the surface of the intermediate transfer film, which surface has the image-receiving layer formed thereon, is approximately $1.0\times10^{8}\Omega$ to $1.0\times10^{13}\Omega$.

13. An image-forming method comprising:

forming a toner image on the surface of an image carrier;

transferring the toner image from the surface of the image carrier onto an image-receiving layer of a belt-shaped intermediate transfer film in which the image-receiving layer is provided on a surface of a release layer, wherein the release layer is provided between a base material and the image-receiving layer of the intermediate transfer film, and the thickness of the base material is approximately 50 μm or less;

superimposing the intermediate transfer film on a surface of a recording medium such that the toner image contacts the surface of the recording medium, the recording medium being a plastic film having a thickness of 100 μm to 1000 μm;

fixing the toner image by application of heat and pressure;

forming a laminate by pressure-bonding the superimposed intermediate transfer film onto the recording medium by application of heat and pressure;

peeling a base material off the image-receiving layer at the interface therebetween, so that the entire image-forming surface of the recording medium is covered with the image-receiving layer and so that the image is formed between the recording medium and the image-receiving layer; and receiving the peeled base material and winding the base material around a winding roll so that the base material accumulates around the winding roll, wherein the peeling strength between the release layer and the image-receiving layer is in the range of approximately 1 gf/cm to 500 gf/cm (approximately 9.8 mN/cm to 4.9 N/cm).

14. An image-forming method comprising:

forming a toner image on the surface of an image carrier;

transferring the toner image from the surface of the image carrier onto an image-receiving layer of a belt-shaped intermediate transfer film in which the image-receiving layer is provided on a surface of a base material, wherein the thickness of the base material is approximately 50 μm or less;

superimposing the intermediate transfer film on a surface of a recording medium such that the toner image contacts the surface of the recording medium, the recording medium being a plastic film having a thickness of 100 μm to 1000 μm;

fixing the toner image by application of heat and pressure;

forming a laminate by pressure-bonding the superimposed intermediate transfer film onto the recording medium by application of heat and pressure;

peeling the base material off the image-receiving layer at the interface therebetween, so that the entire image-forming surface of the recording medium is covered with the image-receiving layer and so that the image is formed between the recording medium and the image-receiving layer; and receiving the peeled base material and winding the base material around a winding roll so that the base material accumulates around the winding roll, wherein the center line average roughness Ra of the surface of the base material, which surface is on the side at which the image-receiving layer is provided, is approximately 20 μm or more.

15. An image-forming apparatus comprising:

an image carrier;

a toner image-forming unit that forms a toner image on the surface of the image carrier;

a belt-shaped intermediate transfer film including a base material and an image-receiving layer provided on a surface of the base material, wherein the thickness of the base material is approximately 50 μm or less;

a transfer unit that transfers the toner image from the surface of the image carrier to the image-receiving layer of the intermediate transfer film;

a heat-pressing unit which fixes the toner image by superimposing the intermediate transfer film on a surface of a recording medium such that the toner image contacts the surface of the recording medium, and applying heat and pressure to the intermediate transfer film and the recording medium, and which forms a laminate by pressure-bonding the intermediate transfer film to the recording medium, the recording medium being a plastic film having a thickness of 100 μm to 1000 μm;

a peeling unit that peels the base material off the image-receiving layer at the interface therebetween; and a winding roll positioned after the peeling unit and receives the peeled base material to wind the base material around the winding roll so that the base material accumulates around the winding roll.

16. The image-forming apparatus according to claim 15, further comprising a temporary fixing unit that preheats the toner image transferred onto the surface of the intermediate transfer film by the transfer unit to temporarily fix the toner image before the fixing.

17. The image-forming apparatus according to claim 15, further comprising a preheating unit that preheats the recording medium before the recording medium is superimposed on a surface of the intermediate transfer film that has the transferred toner image thereon.

18. The image-forming apparatus according to claim 15, wherein the apparatus further comprises a cooling unit that cools the laminate after the laminate is heated and pressurized by the heat-pressing unit, the cooling unit at least comprises a pair of members having substantially planar surfaces that face each other, and the cooling of the laminate is conducted while the laminate is sandwiched between the pair of members.

19. The image-forming apparatus according to claim 18, wherein the apparatus comprises a device that has at least functions of the heat-pressing unit and the cooling unit, and the device comprises at least:

a heating roll that contacts a surface of the intermediate transfer film at a side at which the base material is provided, and stretches the intermediate transfer film;

an endless belt;

a pressure roll that stretches the endless belt and is located to face the heating roll such that the intermediate transfer film and the endless belt come into pressure contact with each other to form a pressure-contact region;

a tension roll that stretches the endless belt together with the pressure roll such that an outer surface of the endless belt faces the surface of the intermediate transfer film at the image-receiving layer side, the intermediate transfer film being conveyed toward a downstream direction of a rotation direction of the heating roll; and a pair of cooling members respectively contacting a surface of the intermediate transfer film at a side at which the base material is provided and an inner surface of the endless belt such that the intermediate transfer film and the endless belt come into pressure contact with each other along a region at which a surface of the intermediate transfer film at a side at which the image-receiving layer is provided and an outer surface of the endless belt face each other, wherein surfaces of the cooling member respectively contacting the surface of the intermediate transfer film at the side at which the base material is provided and the inner surface of the endless belt are substantially planar.

20. The image-forming apparatus of claim 15, wherein the thickness of the base material is substantially between 10 μm and 50 μm.

21. The image-forming apparatus of claim 15, wherein the thickness of the base material is substantially between 18 μm and 40 μm.

22. The image-forming apparatus according to claim 15, wherein the surface resistivity at a temperature of 23° C. and a humidity of 55 RH % of at least the surface of the intermediate transfer film, which surface has the image-receiving layer formed thereon, is approximately $1.0\times10^{8}\Omega$ to $1.0\times10^{13}\Omega$.

* * * * *